United States Patent [19]

Jenkin et al.

[11] Patent Number: 4,888,806

[45] Date of Patent: Dec. 19, 1989

[54] COMPUTER SPEECH SYSTEM

[75] Inventors: Keith R. Jenkin, San Marcos; Shufan Chan, Encinitas, both of Calif.

[73] Assignee: Animated Voice Corporation, San Marcos, Calif.

[21] Appl. No.: 56,502

[22] Filed: May 29, 1987

[51] Int. Cl.[4] ..... G10L 5/00

[52] U.S. Cl. ..... 381/35; 381/36; 381/43; 381/51

[58] Field of Search ..... 381/43, 45, 51-53, 381/35, 36; 364/513.5

[56] References Cited

U.S. PATENT DOCUMENTS

| | | | |
|---|---|---|---|
| 4,271,332 | 6/1981 | Anderson . | |
| 4,415,767 | 11/1983 | Gill et al. | 381/45 |
| 4,682,292 | 7/1987 | Bue et al. . | |
| 4,707,857 | 11/1987 | Marley et al. | 381/43 |

OTHER PUBLICATIONS

Reader's Digest, Mar. 1987, p. 36, "Computer Tutor".

Ramport Product Line Catalog—Hitech Equipment Corp., Jan. 1987.

*Primary Examiner*—Emanuel S. Kemeny

*Attorney, Agent, or Firm*—Fulwider, Patton, Lee & Utecht

[57] ABSTRACT

A computer speech system for digitally storing and reproducing representations of human speech. An analog waveform representative of a segment of speech is compressed for storage by storing companded differences between adjacent local maxima and minima of the waveform together with the lengths of time between the occurrences of the maxima and minima. The compressed speech is reproduced by looking up precomputed values in a lookup table according to the companded differences and times and furnishing the values from the lookup table to a digital-to-analog converter and thence to a conventional audio output device. The values are furnished to the converter by putting them on lower bits of the address bus and performing an operation at an address to which the converter responds. A plurality of segments of speech are stored by selecting, for each segment, a preferred type of representation from a list of options that includes raw data, compressed speech, fricative sounds, repetition of a previous segment, or hold a constant value. A representation of compressed speech is converted into audible speech or is displayed on a computer monitor or analyzed according to a procedure such as a mathematical rule.

41 Claims, 13 Drawing Sheets

COMPUTER SPEECH SYSTEM

BACKGROUND OF THE INVENTION

Field of the Invention

This invention relates generally to the storage and reproduction of human speech by electronic means, and more particularly to the storage and reproduction of human speech by means of a digital computer.

Means for electronically storing and reproducing human speech are well known. Such means generally process the speech entirely in analog form, and while storing and reproducing analog speech signals performs its intended function satisfactorily, there are many desirable operations which cannot be performed on analog speech signals. Among these desired operations are synthesis of spoken words, computer recognition of spoken words, visual display of phonetic elements of spoken words, and the like.

It has long been desired to use digital computers to perform the above operations as well as others which cannot be performed or which cannot be performed satisfactorily solely by means of analog storage and reproduction of speech. Many techniques of storing and reproducing speech in digital form have been tried. Once such technique comprises the storage in digital form of a highly accurate representation of a relatively small number of words. This technique enables a computer to reproduce the stored words in audible form with a very natural sound. However, only a small number of words can be stored in this manner, and the process of generating the necessary data for storage is relatively difficult and expensive. Accordingly, this technique finds a primary application in reproducing, under digital control, one of a selected number of words. Examples of devices embodying this technique include a machine, such as an automobile, which automatically warns its operator in audible form of a dangerous condition, and a talking toy.

Another technique for generation of speech by digital means comprises the use of a phoneme generator. Such a device can generate many words and requires much less data than does the previous technique, but a phoneme generator provides words which are of low quality and, although understandable, tend to have a flat, mechanical sound.

The above techniques, in addition to the drawbacks already discussed, can only be used as devices to provide an audible output of speech data which has been previously stored in a computer, an entirely different technique must be used to enter data indicative of speech into a computer.

A primary method of entering speech data into a computer comprises a microphone coupled to an analog to digital converter. The analog to digital converter periodically samples an analog waveform provided by the microphone and provides the samples to a computer for storage and further processing. If the samples produced by this technique are later applied by the computer to a digital to analog converter, an audible output approximating the original speech input can be obtained. This technique can provide a very high quality of reproduced speech which has characteristics similar to the characteristics of the voice of the person who originally spoke the words which were stored. However, to store very much speech in this manner requires enormous amounts of computer memory. Moreover, although this method can store and reproduce speech accurately, the stored data is highly speaker dependent. The speaker dependence of this technique severely limits its value insofar as any analysis of the speech or actual recognition of the spoken words by the computer is concerned.

Accordingly, there is a need for a way to store human speech in a computer without using unduly large amounts of storage and in a manner which enables the computer to analyze the speech and identify the spoken words independent of the particular voice characteristics of the speaker.

SUMMARY OF THE INVENTION

The present invention provides a computer speech system which compresses a segment of speech by storing companded representations of the differences between successive maxima and minima of a speech waveform, together with the elapsed times between said maxima and minima. The companded differences and the elapsed times are packed together in a single byte for storage, thereby enabling the data to be stored in a relatively small amount of storage space. The particular stored data can be recognized by the computer as representing specific words, or other parts of speech, and this recognition is largely speaker independent.

A method of compressing a segment of speech according to the invention comprises examining a stream of samples of the speech to find a sample which comprises a maximum in relation to its adjacent predecessor and successor samples, examining the following samples to find a sample which comprises a minimum, and calculating (1) a first delta number indicative of the algebraic difference between the minimum and maximum samples and (2) a first time number indicative of how much time elapsed between the occurrences of said samples. The following samples are then examined to find a sample which comprises a maximum in relation to its adjacent neighboring samples, and a second delta number indicative of the algebraic difference between said maximum sample and the previously found minimum sample is then calculated. A second time number indicative of how much time elapsed between the occurrences of said samples is also calculated.

The delta number may comprise a companded representation of the algebraic difference between successive maxima and minima. A delta number and its corresponding time number may be packed, for example into a single data byte for storage.

Various operations may be performed on the segment of speech as represented by the delta numbers and time numbers. The delta numbers and their corresponding time numbers may be compared with previously stored data, and an output indicative of the result of said comparison may be provided. This would be done, for example, if it were desired to compare a segment of speech with a previously stored segment to determine whether the two segments represented the same word or word part (phoneme).

The delta numbers and time numbers may be analyzed in accordance with a predetermined procedure such as a mathematical rule or set of rules.

A visual display indicative of the delta numbers and the time numbers can be generated, for example by plotting points on a computer monitor according to the values of the delta numbers and the time numbers. One such point might be plotted, for example, by reference to an x-y coordinate system in which the x value is determined by the magnitude of the delta number and the y value is determined by the magnitude of the time number. Delta numbers representing a decreasing slope of the speech segment, that is, a slope extending from a maximum to a minimum, may be plotted on one side of the monitor screen and delta numbers representing an increasing slope may be plotted on the other side of the screen to provide a visual indication of the relative phase of the delta numbers. Varying colors on the screen may be used to indicate repetition rates of the various plotted points.

A delta number may be computed by taking the algebraic difference between a sample and a previously determined reference point. For example, the first delta number may be computed by taking the difference between the first minimum sample and a max reference determined according to the preceding maximum sample.

The delta numbers may be companded, for example by a logarithmic expansion, to provide a companded delta number. The companded delta number may be compared with a test value and, if the companded delta number exceeds the test value, the companded delta number may be set equal to the test value. This may be done, for example, to prevent overflow of a companded delta number beyond the maximum size of the storage unit in which the companded delta number is to be stored.

If a time number exceeds a predetermined time, the first delta number and the first time number may be scaled according to a time adjustment factor, and the scaled first delta number then companded to provide the companded delta number. This may be done, for example, to break a long interval into two shorter intervals whereby no stored time interval exceeds the maximum storage space available to store a number representing a time interval.

A plurality of segments of human speech, each segment represented by a stream of samples, may be stored according to the invention by selecting a speech segment to be stored; selecting a segment type, one of which comprises compressing; storing a value indicative of which type was selected; deriving data indicative of the speech segment to be stored according to which type was selected; and then storing the derived data. The compressing type may comprise a method of compressing as outlined above. Other segments types which may also be utilized include fricative synthesis, hold, raw data, repeat, and an automatic type which automatically selects between two or more of the remaining types according to previously provided parameters.

Previously stored data indicative of a segment of human speech can be used to generate a speech signal by computing a numerical value indicative of the data; deriving a computer address according to the computer numerical value; causing a computer to perform an operation accessing the derived address; and applying the derived address to a data input of a signal generating device such as a digital to analog converter. In other words, the data for the digital to analog converter can be transferred from the computer to the converter over an address bus rather than over a data bus. Of course, it would also be possible to transfer the data to the digital to analog converter by means of the data bus if it were more convenient to do so.

The computer address may be derived by, for example, combining the numerical value indicative of the data with a predetermined segment address value The offset portion of the derived address may then by applied to the data input of the digital to analog converter.

Apparatus for generating a speech signal as outlined above comprises a computer including data storage means and an address bus, means for storing the data, means for computing a numerical value indicative of the data, means for deriving a computer address according to the numerical value, means for causing the computer to put the derived address on the address bus, and means for applying the derived address to a data input of the signal generating device.

Other aspects and advantages of the present invention will become apparent from the following detailed description, taken in conjunction with the accompanying drawings, which illustrate by way of example the principles of the invention.

BRIEF DESCRIPTION OF THE DRAWINGS

FIG. 6 comprises two sheets, FIGS. 6*a* and 6*b*.

DESCRIPTION OF THE PREFERRED EMBODIMENT

Figure 1A:
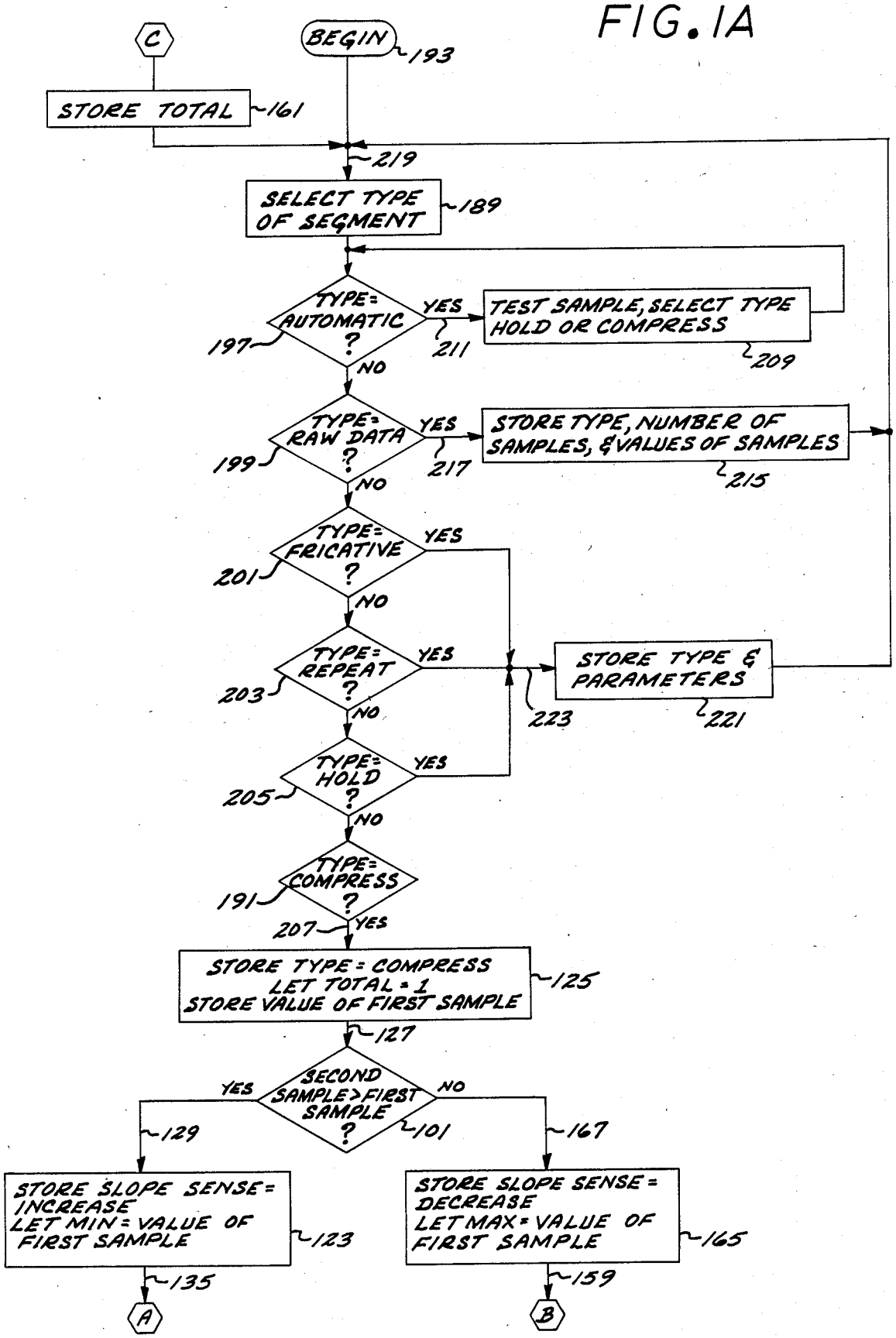
FIGS. 1A, 1B and 1C show a flow chart illustrating a method of compressing speech according to the invention.

As shown in the drawings for purposes of illustration, the invention is embodied in a method and apparatus for compressing, storing and reproducing human speech by means of a computer.

Various methods of storing and reproducing speech by means of computers have been developed, among them the use of precomputed speech segments, the use of phoneme speech synthesizers, and the storage of actual speech by a process of sampling.

A computer speech system according to the invention provides a method for compressing speech by storing key parameters of the speech in a relatively small volume of storage. The parameters tend to be speaker independent and can be displayed or analyzed, for example, by comparison with previously stored speech data.

Figure 1B:
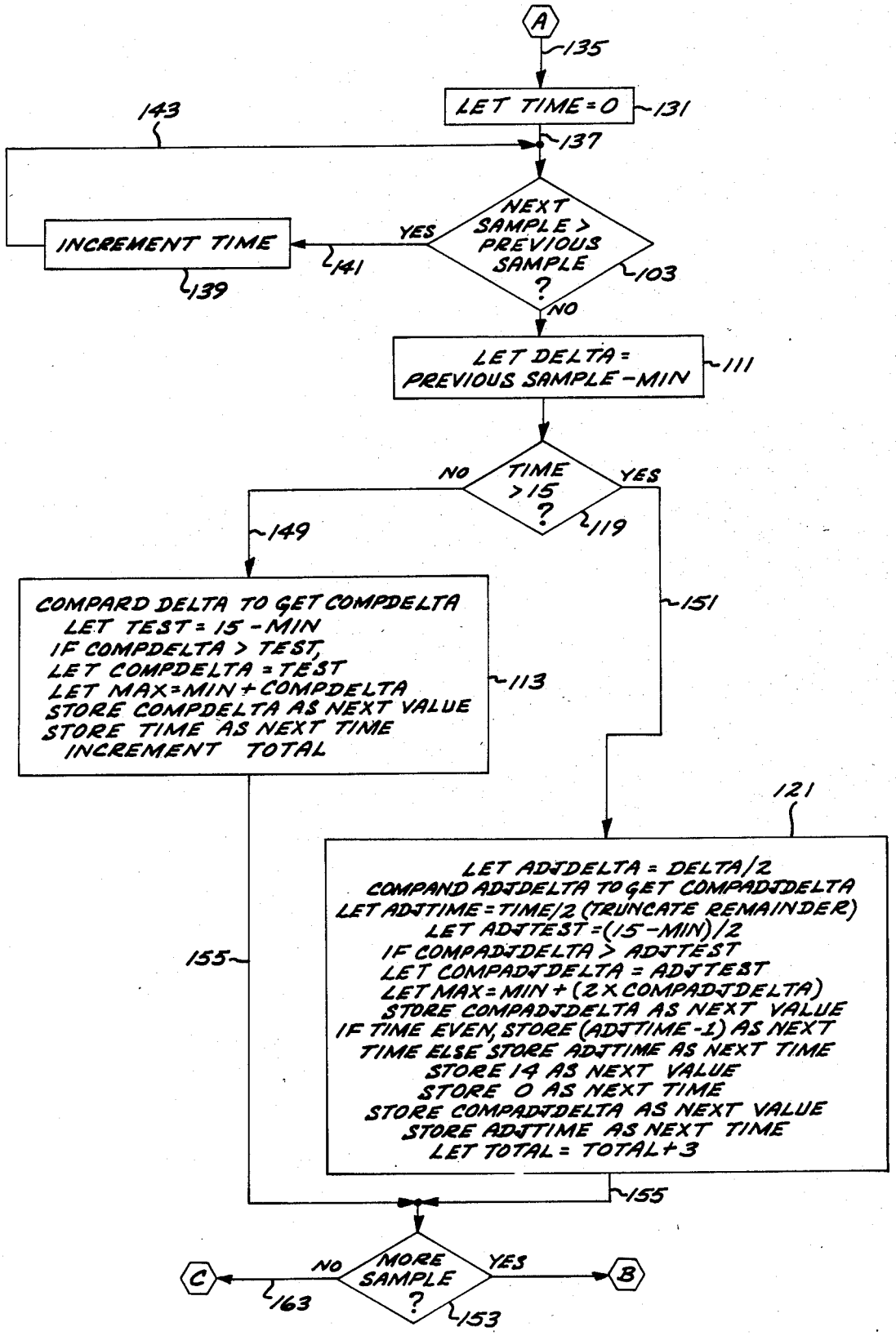
Figure 1C:
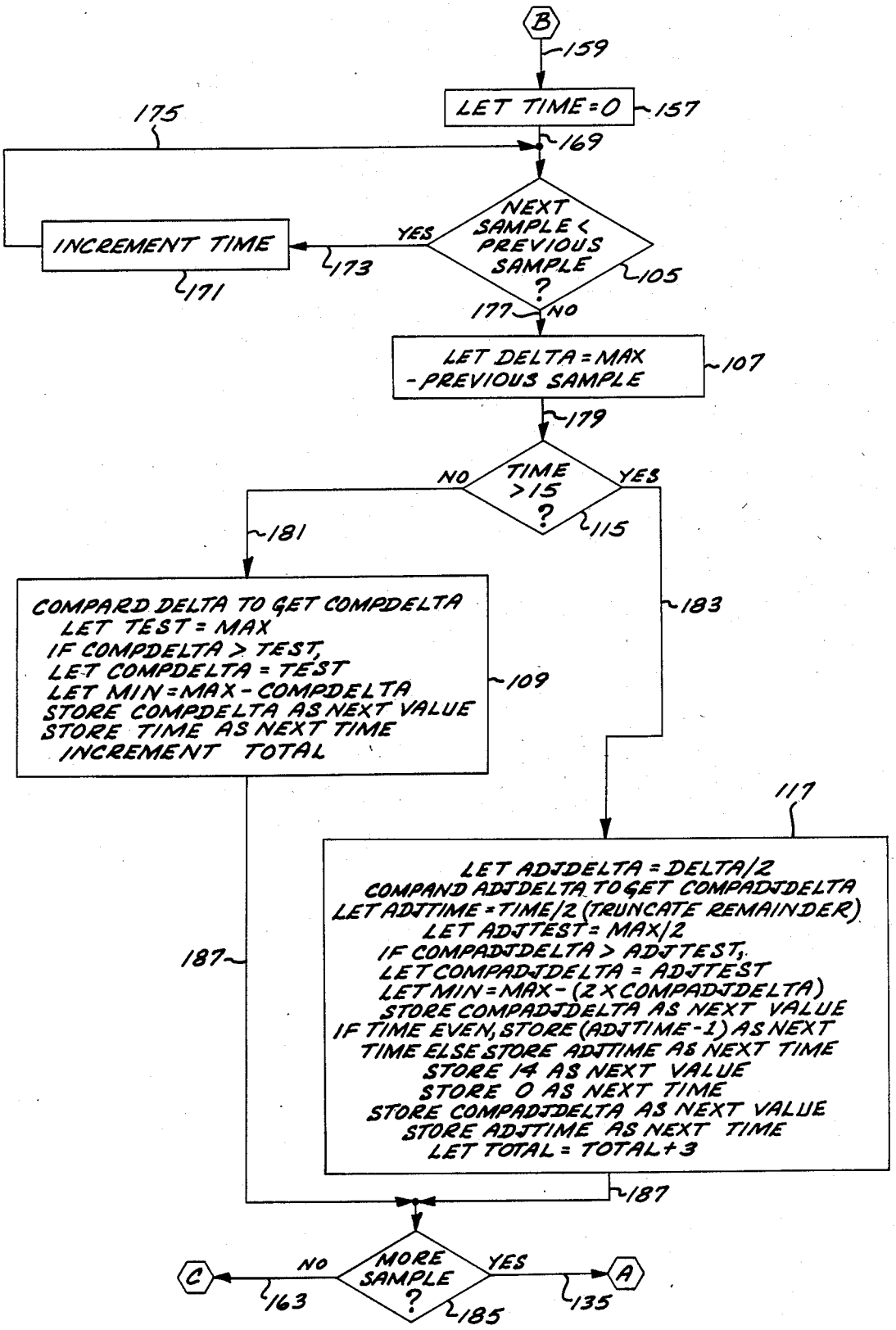

A method of compressing a segment of human speech represented by a stream of samples, as illustrated in FIGS. 1*a*, 1*b* and 1*c* comprises: examining the samples to find a sample which comprises a maximum in relation to its adjacent predecessor and successor samples, as indicated by a "second sample greater than first sample?" decision block 101, and a "next sample greater then previous sample?" decision block 103. The next step comprises examining the samples which follow the maximum sample to find a sample which comprises a minimum in relation to its adjacent predecessor and successor samples, as indicated by a "next sample less than previous sample?" decision block 105. The next step comprises calculating (1) a first delta number indicative of the algebraic difference between the minimum and maximum samples found in the preceding steps, as indicated by a "let diff equals max minus previous sample" block 107, and (2) a first time number indicative of how much time elapsed between the occurrences of said samples, as indicated by a calculation block 109. The next step comprises examining the samples which follow said minimum sample to find a sample which comprises a maximum in relation to its adjacent predecessor and successor samples, as again indicated by the decision 103. The next step comprises calculated (1) a second delta number indicative of the algebraic difference between the maximum sample found in the preceding and the minimum sample found previously, as indicated by a "let delta equal previous sample minus min" block 111, and (2) a second time number indicative of how much time elapsed between the occurrences of said samples, as indicated by a calculation block 113.

A delta number indicative of an algebraic difference may comprise a companded representation of said difference, as indicated in the calculation blocks 109 and 113. A delta number and its corresponding time number may be packed for storage, for example by putting the delta number into one nibble of a data byte and the time number into the other nibble of the same byte.

The first delta number may be calculated by taking the algebraic difference between the minimum sample and a max reference, the max reference being indicated by the designation "max" in the block 107, the max reference having been determined according to the maximum sample. Similarly, the second delta number may be calculated by taking the algebraic difference between the maximum and a min reference value, as indicated by the designation "min" in the block 111, the min reference value having been determined according to the minimum sample.

A companded delta number may be compared with a test value, and if the companded delta number exceeds the test value, the companded delta number may be set equal to the test value, as indicated in the computation blocks 109 and 113.

If the first time number exceeds a predetermined time, as indicated in a decision block 115, the first delta number and the first time number may be scaled according to a time adjustment factor indicated by the designation "adjtime" in a calculation block 117, and the scaled first delta number may then be companded to provide a first companded delta number. Similarly, if the second time number exceeds the predetermined time as indicated by a decision block 119, the second delta number and the second time number may be scaled according to a time adjustment factor and the scaled delta number then companded to provide the companded second delta number, as indicated in a computation block 121.

A "min" reference value may have been determined by taking a value of the first of the stream of samples, as indicated in a block 123. Similarly, a reference time number may be calculated indicative of how much time elapsed between the first maximum sample and the first sample. This reference delta number may then be companded to provide a companded delta reference number and a max reference value may then be determined by adding the companded reference delta number to said min reference value, as indicated in the calculation block 113. A new min reference value may thereafter be determined by subtracting the first companded delta number as determined in the calculation block 109, from the max reference value as also indicated in the calculation block 109, and then replacing the previously determined min reference value with the new min reference value. Similarly, after the second delta number has been calculated, a new max reference value can be determined by adding the second companded delta number to the min reference value and replacing the previously determined max reference value with the new max reference value all as indicated in the calculation block 113.

Following the flow chart of FIG. 1*a*, 1*b* and 1*c* in sequence, the compression routine begins with a calculation block 125 comprising three steps. The first step, "store type equal compress", stores a value indicative of the compression type to distinguish the type of segment from some other type which may be selected, as will be more particularly discussed in a subsequent paragraph. The second step of the block 125 "let total equal one", sets a counter designated as "total" equal to one, representing the first sample. The third step of the block 125 "store value of first sample", indicates that the value of the first of stream of samples is to be stored. The block 125 leads to the decision block 101 as indicated by a line 127.

If the second sample exceeds the first sample, as indicated by the decision block 101, the steps in calculation block 123 are performed, as indicated by a line 129 extending from a "yes" output of the decision block 101 to the block 123. The first step of the block 123, "store slope sense equal increase", indicates that a value indicating an increasing slope is to be stored. The second step of the block 123, "let min equal value of first sample", determines an initial min reference value.

A block 131 follows the block 123 as indicated by a line 135. The block 131 comprises a single step, "let time equal zero", to set a counter designated as "time" to zero. The next step is the decision block 103 as indicated by a line 137 connecting the block 131 to the decision block 103. If the next sample exceeds the previous sample, the "time" is incremented, as indicated by a block 139 connected to a "yes" output of the block 103 as indicated by a line 141. After the time is incremented, another sample is tested, as indicated by a line 143 extending from block 139 back to the input of the decision block 103.

Eventually, a maximum will have been reached, which will be indicated by a "no" output from the decision block 103. When this happens, the step in the block 111 is next performed, as indicated by a line 145 extending from the "no" output of the block 103 to the block 111.

After performing the step in the block 111, the decision block 119 is next encountered, as indicated by a line 147 connecting the block 111 to the decision block 119. A "no" output of the decision block 109 is connected to the computation block 113 as indicated by a line 149, and a "yes" output of the decision block 119 is connected to the computation block 121 as indicated by a line 151.

The computation block 113 comprises the steps of "compand delta to get comp delta", "let test equal fifteen minus min", "if comp delta greater than test, let comp delta equal test comp", "let max equal min plus comp delta", "store comp delta as next value", "store time as next time", and "increment total".

The steps of calculation block 121 include "let adjdelta equal delta/2", "compand adjdelta to get comp adjdelta", "let adjtime equal time/2 (truncate remainder)", "let adjtest equal (15 minus min)/2", "if compadjdiff greater than adjtest, let comp adjdiff equal adjtest", "let max equal min plus (2×comp adjdiff)", "store comp adjdiff as next value", "if time even, store (adjtime minus one) as next time else store adjtime as next time", "store 14 as next value", "store 0 as next time", "store comp adjdiff as next value", "store adjtime as next time", and "let total equal total plus three".

After performing the steps in either calculation block 113 or calculation block 121, which ever has been performed, the step in a decision block 153, specifically "more samples?", is next performed, as indicated by a line 155 extending from both blocks 113 and 121 to decision block 153.

If there are more samples to be processed, a step in a block 157 is next performed, as indicated by a line 159 connecting a "yes" output from the decision block 153 to the block 157. If no more samples are to be processed, execution of the compress type segment ends with storing the contents of the "total" counter, as indicated by a block 161 connected to a "no" output of the decision block 153 through a line 163.

Returning now to the decision block 101, if the second sample exceeds the first sample, the steps of a block 165 are next performed, as indicated by a line 167 connecting a "no" output of the decision block 101 to the block 165. The steps of the block 165 are similar to those of the block 123 except that the initial slope sense is "decrease" and the initially defined reference value is designated as "max" rather than "min".

After the block 165, the block 157 is performed as indicated by the line 159 connecting the output of the block 165 with the block 157. The block 157 is similar to the block 131. The output of the block 157 is connected to the input of the decision block 105 as indicated by a line 169.

The block 105 is similar to the block 103 except that the next sample is tested to see whether it is less than the previous sample. If the next sample is less than the previous sample, the "time" counter is incremented as indicated by a block 171 connected to a "yes" output of the block 105 as indicated by a line 173. The output of the block 171 is returned back to the input of the decision block 105 as indicated by a line 175.

If the next sample is not less than the previous sample, a minimum has been encountered, as indicated by a "no" output of the decision block 105 connected to the block 107 through a line 177. The block 107 in turn is connected to the input of the decision block 115 as indicated by a line 179.

The decision block 115 is similar to the decision block 119 as previously discussed. A "no" output of the decision block 105 is connected to the calculation block 109 as indicated by a line 181, and a "yes" output of the decision block 115 is connected to the calculation block 117 as indicated by a line 183.

The steps of the decision block 113 are similar to the steps of the decision block 109 except that the "test" variable is set equal to "max" and the "min" variable is set equal to "max minus comp delta".

The steps of the calculation block 117 are similar to the steps of the calculation block 121 except that the variable "adjtest" equals "max/2", the variable "min" is set equal to "max minus (2×comp adjdiff)".

After performing the steps of the blocks 109 or 117, whichever were executed, a step "more samples" in a decision block 185 is next performed, as indicated by a line 187 connecting both blocks 109 and 117 to the decision block 185.

If more samples are to be processed, the step in the block 131 is next performed, as indicated by the line 135 connecting a "yes" output of the decision block 185 to the block 131. If no more samples are to be processed, the step in the block 161 is performed as indicated by the line 163 connecting a "no" output of the decision block 185 to the block 161.

Figure 2:
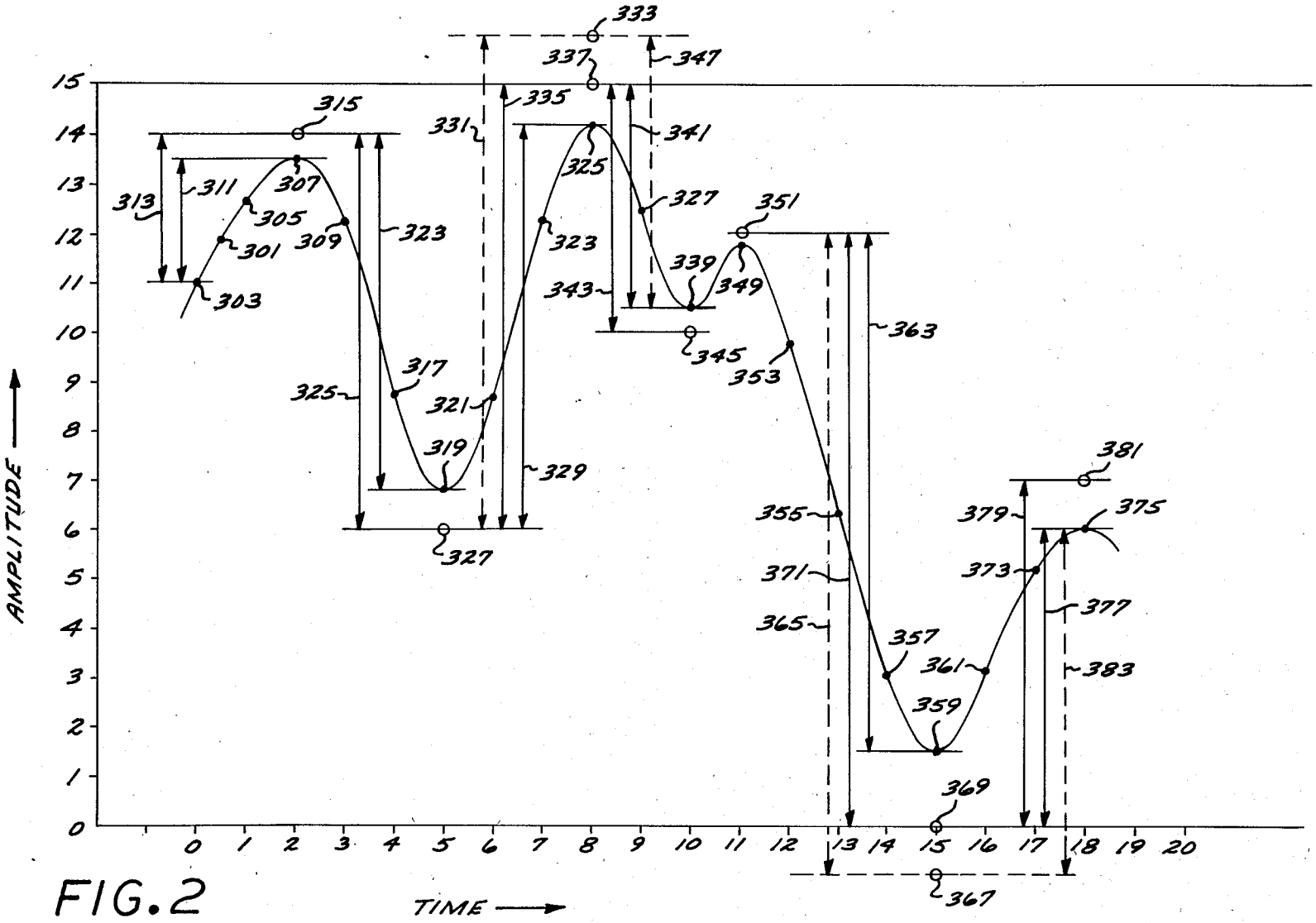
FIG. 2 is a graph illustrating certain of the steps of the flow chart of FIG. 1.

The steps of the above described compression procedure are illustrated graphically in FIG. 2. A short section of human speech is represented by an analog wave-from 301. A first sample 303 is taken at time t equal 0 and the value of this sample is stored as indicated in block 125 of FIG. 1*a*. A second sample 305 is determined to be greater than the first sample 303, and accordingly an increase slope sense is stored as indicated in block 123. A third sample 307 is compared with the second sample 305 as indicated in the block 103. A fourth sample 309 is compared with the third sample 307, again as indicated in the block 103, and since the fourth sample 309 is less than the third sample 307, a decision is made that the third sample 307 represents a maximum.

Returning to block 123, the value of the first sample 303 was set equal to the variable "min". Then in block 111, min is subtracted from the value of the sample 307, yielding a value for delta the magnitude of which is indicated by an arrow 311. This delta, as indicated by the arrow 311, is then companded to get a companded delta as indicated by the block 313. The value of the companded delta is then added to the min reference to get a new max reference as indicated by a point 315.

The time counter was incremented from zero to one and from one to two according to the analysis of the samples, and the time t equal 2 corresponds with the time between the first sample 303 and the sample 307. The companded delta and the time are now stored, all as indicated in the block 113.

It is assumed that after a maximum will come a minimum, and accordingly program execution now passes to block 157 as shown in FIG. 1*c*. The time counter is reset and the samples are evaluated until a minimum is found. A sample 317 is determined to be less than the sample 309, a sample 319 is determined to be less than the sample 317, and a sample 321 is determined to be greater than the sample 319, thereby establishing the sample 319 as a minimum, according to the decisions made by the step in the decision block 105. The magnitude of the sample 319 is subtracted from the previously determined maximum reference as indicated by the point 315 to get a delta as indicated by an arrow 323. This delta is then companded to get a companded delta as indicated by an arrow 325. The value of the companded delta as indicated by the arrow 325 is then subtracted from the maximum reference as indicated by the point 315 to get a new minimum reference as indicated by the point 327.

It is now assumed that an increasing slope will be determined, a minimum having been reached, and therefore the step in block 131 is again executed. A sample 323 is compared with the sample 321, and a sample 325 is compared with the sample 323, and a sample 327 is compared with the sample 325. This results in a determination that the sample 325 represents a maximum.

The difference between the sample 325 and the minimum point 327, as illustrated by an arrow 329, is companded to provide a companded delta as indicated by an arrow 331.

When the companded delta as represented by the arrow 331 is added to the minimum as represented by the point 327, a new maximum point is established as indicated by the point 333. However, the maximum point 333 lies outside a permissible range as indicated by an amplitude value 15 on the graph, and therefore the companded delta must be reduced as indicated by an arrow 335 defining a new max reference point 337 which does not exceed the maximum permissible value of 15 on the amplitude chart. The value 15 on the amplitude chart corresponds with the variable "test" indicated in the blocks 113 and 109.

In a manner similar to that previously described, a point 339 is determined to represent a minimum and the difference between the point 339 and the max reference point 337, as represented by an arrow 341, is companded as indicated by an arrow 343, to establish a new minimum reference point 345. If the maximum reference point 337 had not been reduced from the maximum computed reference 333, the difference between the point 339 and the previous reference point 333 would have been as indicated by the arrow 347. During playback, the companded deltas as represented by the arrows 331 and 347 would have led to erroneous results because they dealt with a maximum reference which exceeded the maximum permissible amplitude of 15.

In due course, a point 349 is determined to represent a maximum, and a maximum reference point 351 is computed with reference thereto, the arrows indicating the differences and the deltas not being shown. Points 353, 355, 357, 359 and 361 are then analyzed, and the point 359 is determined to represent a minimum. The difference between the point 359 and the previous maximum point 351 is represented by an arrow 363 and when companded this leads to a companded delta as indicated by an arrow 365. However, if the companded delta as represented by the arrow 365 is subtracted from the previous maximum reference point 351, the result will be a new minimum reference point 367 which is below the minimum permissible amplitude. Accordingly, the companded difference between the minimum point 359 and the previous max reference 351 is reduced so that the minimum reference determined thereby will not be lower than the minimum allowable amplitude of zero, as indicated by a minimum reference point 369 and an arrow 371 defining the minimum point 369.

A point 373 and a point 375 are next analyzed, and it is determined that the point 375 represents a maximum. Accordingly, a delta as represented by an arrow 377 is computed between the maximum sample 375 and the previous minimum reference point 369 as corrected. This delta as represented by the arrow 377 is companded as indicated by an arrow 379 to provide a new max reference point 381. Had the correction to the previous minimum reference point not been made, the difference between the maximum point 357 and the previous minimum reference 367 would have been as indicated by an arrow 383, and this value along with a companded difference represented by the arrow 365, would have led to erroneous results because they exceeded the permissible amplitude range.

Figure 3:
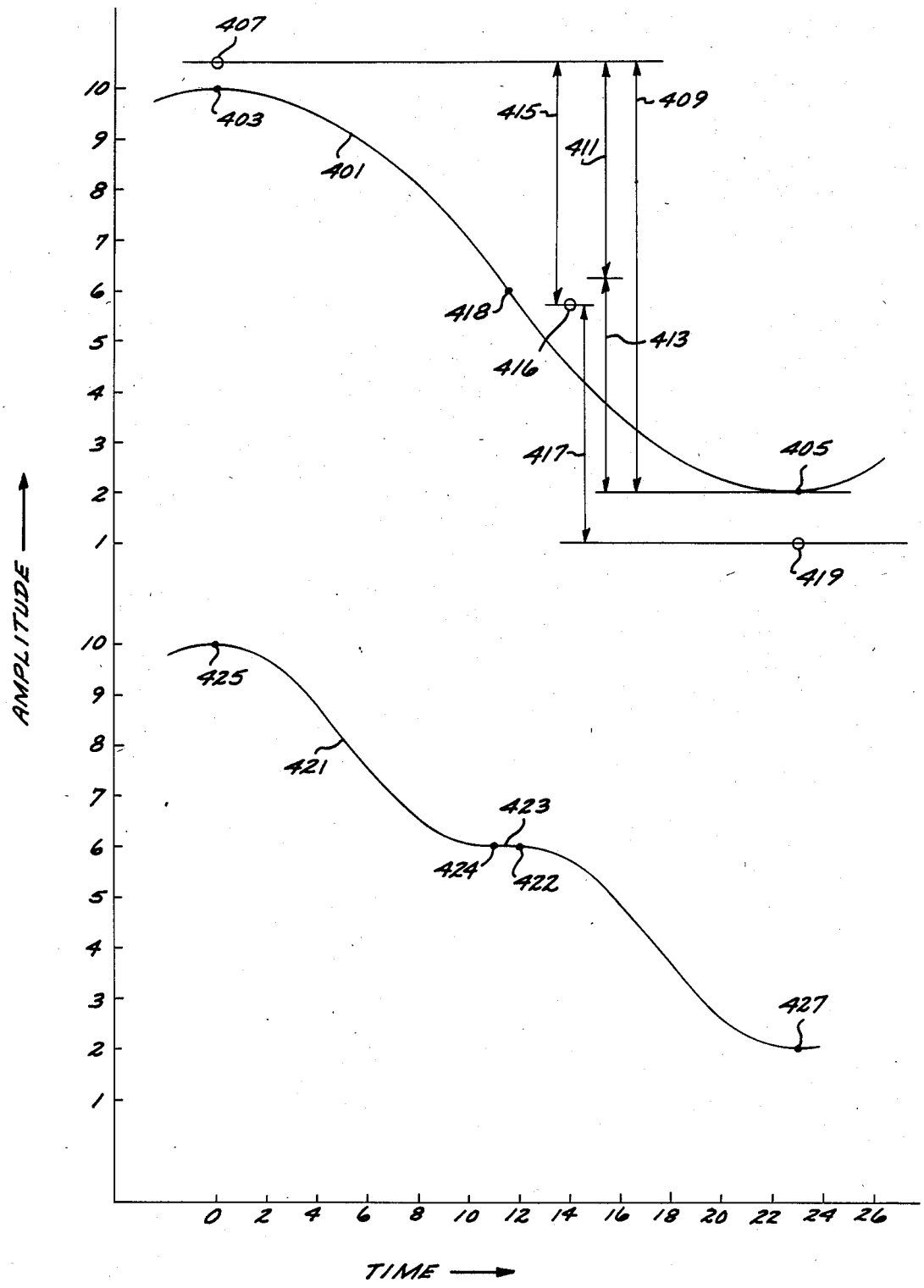
FIG. 3 is a graph illustrating others of the steps of the flow chart of FIG. 1.

An adjustment according to the value of the time number, as carried out in the blocks 117 and 121, is illustrated graphically in FIG. 3. A curve 401 representing a low frequency sine wave section of human speech, has a maximum point 403 and minimum point 405 which are separated by more than 15 increments of time. In the figure, the points 403 and 405 are separated by 23 increments. Accordingly, the difference between a max reference point 407, previously determined from the sample 403, and the sample 405, as represented by an arrow 409, must be scaled. The scaling is carried out by dividing the delta as represented by the arrow 409 in two, as represented by the arrows 411 and 413, each of which is one half the value of the arrow 409. The delta represented by the arrow 411 is then companded, as indicated by an arrow 415, and since the value of the arrow 411 is equal to the value 413 the companded value of the arrow 411 is also used to construct a second companded value as indicated by an arrow 417. The companded deltas represented by the arrows 415 and 417, when added together and then subtracted from the previously determined maximum reference point 407, define a new minimum reference point 419.

The adjusted companded delta as represented by the arrow 415 is then stored, along with an adjusted time which is equal to one half of the total time interval between the sample points 403 and 405. Next, a dummy data byte represented by a "14" as a delta value and a 0 as a time are stored, and these two values, upon decompression later on, indicate that no change in slope is to occur. Following these two values, the companded adjusted delta as represented by the arrow 417, together with the adjusted time, again being one half the total time between the points 403 and 405, are then stored.

If the total time between the points 403 and 405 were even, it would be necessary, upon storing one half of the time, to adjust one of the two time periods by a factor of 1 to allow for storing the 0 and 14 values and yet not change the fundamental frequency as represented by the time interval between the points 403 and 405. This is done as indicated in the blocks 117 and 121 by truncating the remainder of dividing the time interval by two, if the result is odd, or by subtracting one from the first adjusted time to be stored if the time is even before division.

Upon decompression, the values stored as described above will result in an output waveform which is slightly distorted as compared with the waveform 401. This resulting output waveform is shown as a curve 421 which has a flat portion 423 midway in between its maximum points 425 and 427. The points 425 and 427 correspond with the input sample points 403 and 405, respectively. Although the waveform 421 looks somewhat different than the waveform 401, in the context of a low frequency component of human speech the difference in most cases is not audible.

A method of storing a plurality of segments of human speech, each segment represented by a stream of samples, comprises selecting a speech segment to be stored, as indicated by a block 189 in FIG. 1*a*. Next, one of a plurality of segment processing types (or modes) is selected, one of which types comprises compressing, as indicated in a decision block 191. A value indicative of which segment processing type was selected is stored, as has previously been discussed with reference to block 125. Next, data indicative of the speech segment to be stored are derived, according to which segment type was selected, and finally the derived data are stored.

More particularly, the storage of the plurality of segments starts with a "begin" block 193 connected to the block 189 by a line 195. Any of a number of segment processing types (or modes) may be selected. Among these types are an "automatic" type, as indicated by a decision block 197, a "raw data" type as indicated by a decision block 199, a "fricative" type as indicated by a decision block 201, a "repeat" type as indicated by a decision block 203, and a "hold" type as indicated by a decision block 205. In FIG. 1*a*, the decisions blocks 191 and 197–205 are shown as connected to each other in serial fashion, but it will be apparent that it is not necessary to actually execute all of these decision blocks in order to select the desired type of segment.

If the type "compress" has been selected, execution then passes to the compress routine as previously discussed, as indicated by a line 207 connecting a "yes" output of the block 191 to the block 125. If the type "automatic" is selected, the samples are tested and a "hold" or a "compress" type, according to the result of testing the samples, is performed, as indicated by a block 209 connected to a "yes" output of the decision block 197 as indicated by a lien 211. After the "hold" or "compress" type has been performed, control then returns back to the "automatic" type as indicated by a line 213 extending from the block 209 back to the decision block 197.

If the type "raw data" has been selected, a block 215, comprising the step of "store type, number of samples, and values of samples", is performed, as indicated by a line 217 connecting a "yes" output of the decision block 199 to the block 215. After the step in the block 215 has been performed, control is returned back to the block 189 as indicated by a line 219 extending from the block 215 to the block 189.

It will be noted that the same line 219 also connects the output of the block 161 to the block 189.

If any of the types fricative, repeat, or hold have been selected, then appropriate type and parameter information are stored, as indicated by a block 221. The block 221 is connected to a "yes" output of each of the blocks 201, 203 and 205 as indicated by a line 223.

The parameters to be stored for the type "fricative", the type "repeat", or the type "hold", may comprise, for example, information as to the duration, pitch, amplitude, timber, or other characteristics appropriate to the type of segment being stored. To store a fricative type, it might be that all of said parameters would be stored.

Companded delta numbers and time numbers which have been derived according to the compression method described above can be used immediately after they are generated instead of being stored. For example, the companded delta numbers and time numbers can be compared with previously stored data such as other companded delta numbers and time numbers and an output indicating the result of said comparison can be provided. For example, such a technique could be used to determine whether a word just spoken is the same or different than a word, a compressed representation of which has previously been stored. Such a procedure is illustrated in FIG. 4.

Figure 4:
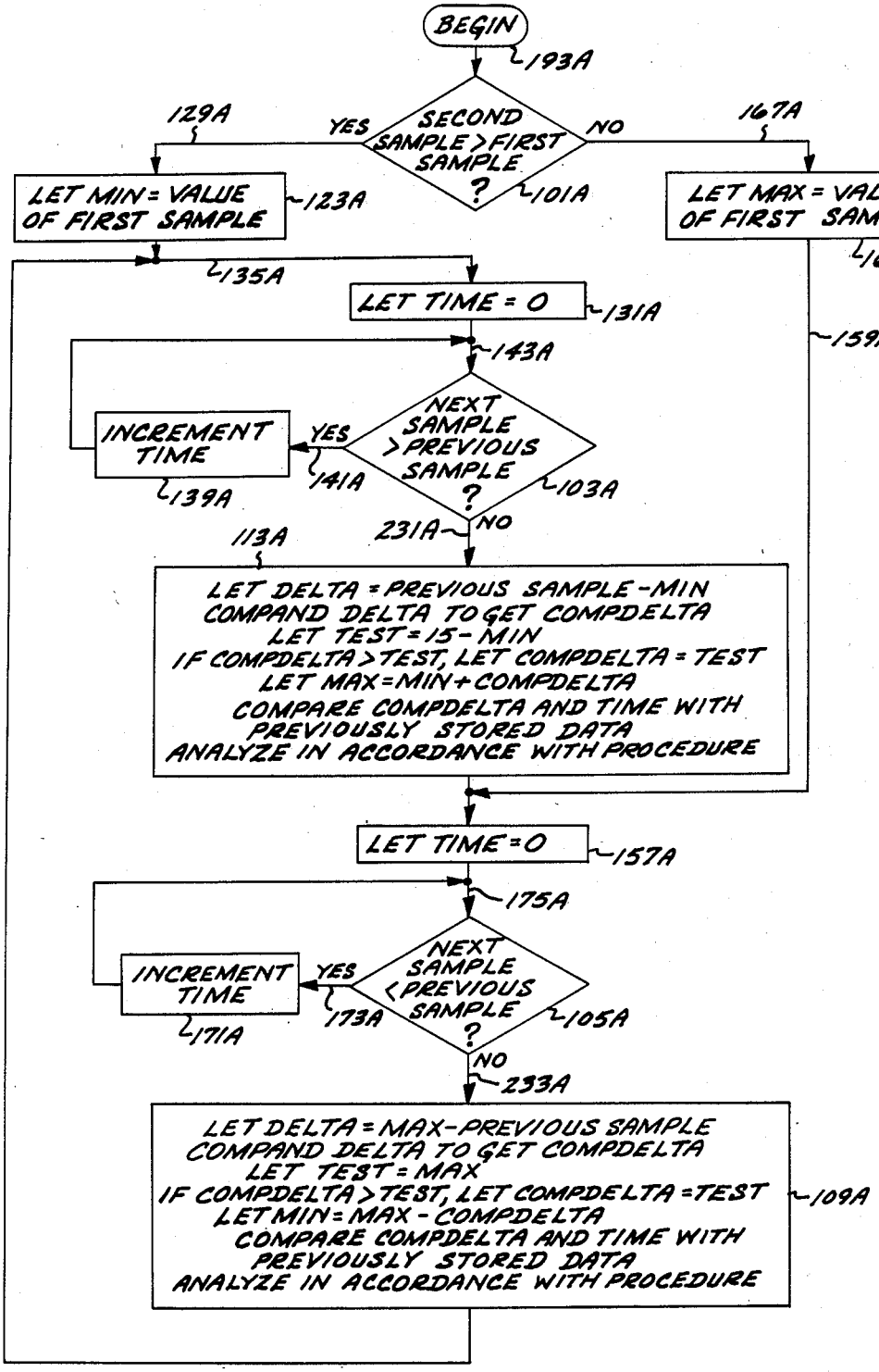
FIG. 4 is a flow chart illustrating a compression procedure including the step of comparing or the step of analyzing the data.

FIG. 4 illustrates a compression routine similar to that illustrated in FIGS. 1*a* through 1*c* and previously discussed, and similar elements are identified by similar reference numbers with the suffix "a" attached. In the calculation block 113*a*, the steps of storing data, as shown in FIG. 1*b*, have been omitted and instead the step of "compare comp delta and time with previously stored data" has been substituted. Likewise, in block 109*a*, the storage steps illustrated in FIG. 1*c* have been omitted and instead the step "compare comp delta and time with previously stored data" has been included.

Figure 5:
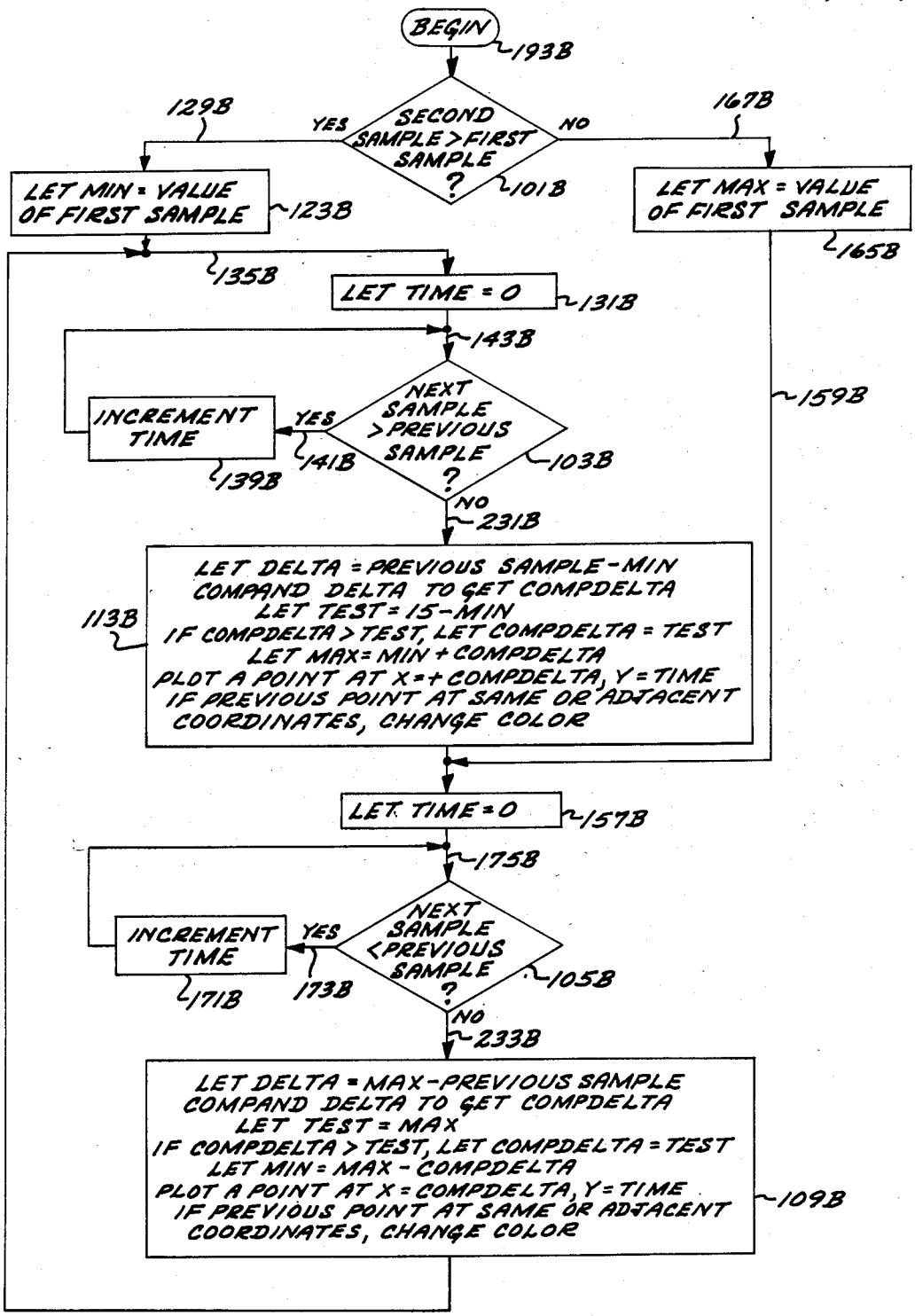
FIG. 5 is a flow chart similar to that of FIG. 4 but illustrating displaying the data on a visual display.

A visual display indicative of the companded delta numbers and the time numbers may be generated, for example by means of a computer monitor screen. A routine which generates such a visual display is illustrated in FIG. 5. The routine illustrated in FIG. 5 is similar to the compression routine previously discussed and illustrated in FIG. 1*a* through 1*c*, and similar elements are identified by the same reference numbers with the suffix "b" attached.

In the calculation block 113*b*, the steps of storing the data as illustrated in FIG. 1*b* have been omitted and instead the steps "plot a point at x equals plus comp delta, y equals time", and "if previous point at same or adjacent coordinates, change color" have been included.

Similarly, in the calculation block 109*b*, the storage steps as illustrated in FIG. 1*c* have been omitted, and instead the steps "plot a point at x equals minus comp delta, y equals time", and "if previous point at same or adjacent coordinates, change color" have been included.

By plotting the plus comp delta and minus comp delta points on opposing sides of the screen, a display which indicates relative phase is presented. Such a display is particularly valuable for use, for example, for speech therapy purposes wherein a hearing impaired person is being taught to speak. By matching the output of the person's own vocal cords with a previously stored reference, as indicated by the points plotted on the display, the person can conform the sound coming from his or her vocal cords with a desired sound.

The color of the display, or the brightness of the display if desired, can be varied according to the number of repetitions of a given point.

The delta numbers and time numbers may be analyzed according to a predetermined procedure, as indicated by a step "analyze according to procedure" in blocks 113*a* and 109*a* of FIG. 4. Such a procedure may comprise a mathematical rule or some other procedure by which the delta numbers and time numbers are analyzed. It will be apparent that, in any given execution of the program, either the "analyze" step or the "compare" step may be performed, but both of them need not be performed during the same program execution.

A method of generating a speech signal from data indicative of a segment of human speech comprises computing a numerical value indicative of the data, deriving a computer address according to the computed numerical value, causing a computer to perform an operation accessing the derived address, and applying the derived address to a data input of a signal generating device, as indicated in a computation block 501 and a computation block 503 of FIG. 6. The step of deriving a computer address may comprise combining the numerical value with a predetermined segment address value to derive the address, an offset portion of the derived address being indicative of said numerical value. The step of applying the derived address to the data input may comprise applying the offset portion of the derived address to the data input. The step of combining the numerical and segment address values may comprise storing the numerical value in a first register, storing a predetermined segment address value in a second register, and combining the contents of the two registers to derive the computer address. Finally, the step of combining the contents of the registers may comprise multiplying the contents of the second register by a constant to provide a segment address and adding the segment address to the contents of the first register.

The step of computing the numerical value may comprising looking up a numerical value in a look up table, again as indicated in the block 501.

More particularly, the flow chart of FIG. 6 illustrated a procedure for generating speech based on data which has previously been stored in accordance with the previous discussion. Program execution begins at a beginning point 505 and proceeds to a group of decisions blocks to determined what type of segment is the next speech segment to be reproduced. If the type segment is raw data, as indicated by a yes output from a decision block 507, specified values are sent to a digital to analog converter ("DAC") as indicated by a block 517 connected to the yes output as indicated by a line 519. If the segment type is fricative, as indicated by a yes output from the decision block 509, repeat, as indicated by a yes output of the decision block 511, or hold, as indicated by a yes output from the decision block 513, stored parameters are used to generate values which in turn are sent to the DAC, as indicated by a block 521 connected to said yes outputs as indicated by a line 523. After one of the procedures indicated in the blocks 517 or 521 has been completed, control returns to the beginning as indicated by a line 525 extending from said blocks back to the first decision block 507.

If the speech type is compressed, as indicated by a line 527 extending from a yes output of the decision block 515, the slope sense is first determined as indicated by a decision block 529 connected to the line 527. If the slope sense is increase, the steps in a block 531 are executed as indicated by a line 533 connecting a yes output from the decision block 529 to the block 531. If the initial slope sense is decrease, then the steps of a computation block 535 are executed instead, as indicated by a line 537 extending from a no output of the decision block 529 to the block 535. The steps of the blocks 531 and 535 are substantially similar; they comprise "put address of next speech segment in point or register", "put value of first data byte in value register", and "send contents of value register to DAC". After execution of the calculation block 531, a step "increment program counter" contained in a block 539 is executed as indicated by a line 541 connecting the block 531 with the block 539. Next, the program counter is compared with the pointer register as indicated in a decision block 543 connected tot he block 539 by a line 545. If the two values are equal, it means that all of the speech segment has been processed, and it is time to return to the beginning. This is indicated by the line 525 which extends from a "yes" output of the decision block 543 back to the first decision block 507. If the program counter is not equal to the pointer register, then the steps in the block 501 are executed as indicated by a line 547 extending from a "no" output of the decision block 543 to the block 501. Up to this point, the execution of the steps is substantially similar as it would have been if the block 535 were executed, the block 535 connecting to a block 549 similar to the block 539 through a line 551. The block 549 in turn connects to a decision block 553, similar to the block 543, as indicated by a line 555 extending from the block 549 to the block 553. A yes output of the block 553 returns to the input through the line 525, and a no output of the decision block 553 connects to a calculation block 557 as indicated by a line 559 connecting the no output of the decision block 553 to the block 557. The instructions in the block 557 are substantially similar to the instructions in the block 501.

After the instructions in the block 501 have been executed, the instructions in the block 503 are executed, as indicated by a line 561 extending from the block 501 to the block 503. The instructions in the block 503 include: "send next value to look up table", "add value returned from look up table to value register", "send contents of value register to DAC", and "decrement timer register".

Similarly, if the steps in the block 557 have been executed, next a set of steps contained in a block 563, which instructions are similar but not identical to those contained in the block 503, are executed. The block 557 is connected to the block 563 as indicated by a line 565. The instructions in the block 563 are similar to those in the block 503 except for the second instruction, which in the block 563 comprises the step "subtract value returned from look up table from value register".

Returning to the block 503, after the steps in said block have been executed control passes to a decision block 567 which contains the step: "timer register equals zero?". If the timer register has not yet reached zero, the steps in the block 503 are executed again, as indicated by a line 569 extending from a no output of the decision block 567 back to the block 503. Similarly, after the block 563 instructions are executed, a decision block 571, similar to the block 567, is encountered as indicated by a line 573 connecting the block 563 to the decision block 571. A "no" output of the decision block 571 returns back to the block 563 as indicated by a line 575. If the timer register equals zero, as indicated in the block 567, the sense of the slope is ready to reverse and program control is transferred to the block 549 as indicated by a line 577 extending from a yes output of the decision block 567 to the block 549. Similarly, if the timer register as indicated in the block 571 equals zero, it is time for the slope sense to change in the opposite direction, as indicated by a line 579 extending from a yes output of the decision block 571 back to the block 539.

In this manner, each time a timer register reaches zero, the sense of the slope changes from increase to decrease and back to increase again, corresponding with the fact that each stored companded delta and time number reflects alternately increasing and decreasing values of the original speech waveform. In this way, the original speech waveform is accurately reproduced.

Figure 7:
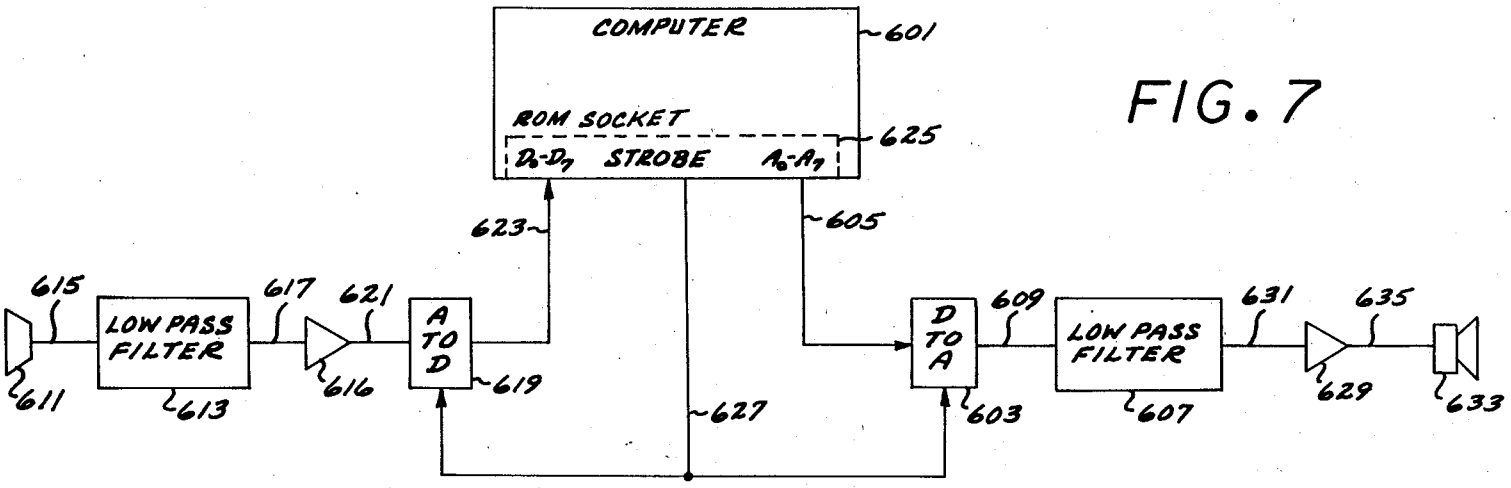
FIG. 7 illustrates a direct connection of computer processing circuitry to a ROM socket of a computer.

Apparatus for generating a speech signal comprises: a computer including data storage means and an address bus, as indicated by a block 601 in FIG. 7. The apparatus also comprises means for storing data indicative of a segment of human speech in the data storage means, means for computing a numerical value indicative of the stored data, means for deriving a computer address according to the computed numerical value, means for causing the computer to put the derived address on the address bus, and means for applying the derived address to a data input of a signal generating device. The preceding means may comprise software, hardware, or a mix of the two.

The signal generating device may comprise a digital to analog converter 603 having a data input in electrical communication with the address bus as indicated by a line 605 and responsive to an address placed on the address bus to provide an analog signal indicative of the numerical value of said address.

A low pass filter 607, operative to filter the analog signal to provide a speech signal, may receive the signal from the digital to analog converter 603 as indicated by a line 609 connecting the two.

Apparatus for deriving the computer address may comprise means for combining the numerical value with a predetermined segment address value to derive the address, an offset portion of the derived address being indicative of said numerical value. The means for combining the numerical and segment address values may comprise: first and second computer registers, operative to store the numerical value and the predetermined segment address value, respectively, and means for combining the contents of the first register with the contents of the second register to derive the computer address.

The computer 601 may receive the speech information from a microphone 611 which provides an analog signal to a low pass filter 613 as indicated by a line 615 connecting the two. The output of the low pass filter 613 may be amplified by an amplifier 615 connected to the low pass filter 613 as indicated by a line 617, and the output of the amplifier 615 may be applied to an analog to digital converter 619 as indicated by a line 621 connecting the analog to digital converter 619 to the amplifier 615.

In a preferred embodiment, the data output line 623 of the analog to digital converter 619 are connected data inputs of a ROM socket 625 in the computer 601. Address lines from the ROM socket, as indicated by the line 605 are connected to the digital to analog converter 603. A strobe signal from the ROM socket 625, as indicated by a line 627, is applied to both the analog to digital converter 619 and the digital to analog converter 603. In this fashion, all connections between the speech circuitry and the computer can be handled through the ROM socket. By putting the data to the output to the digital to analog converter 603 onto the address lines, it is possible for data to be output through the ROM socket 625, even though said ROM socket 625 is intended only to pass data to the computer.

Figure 8:
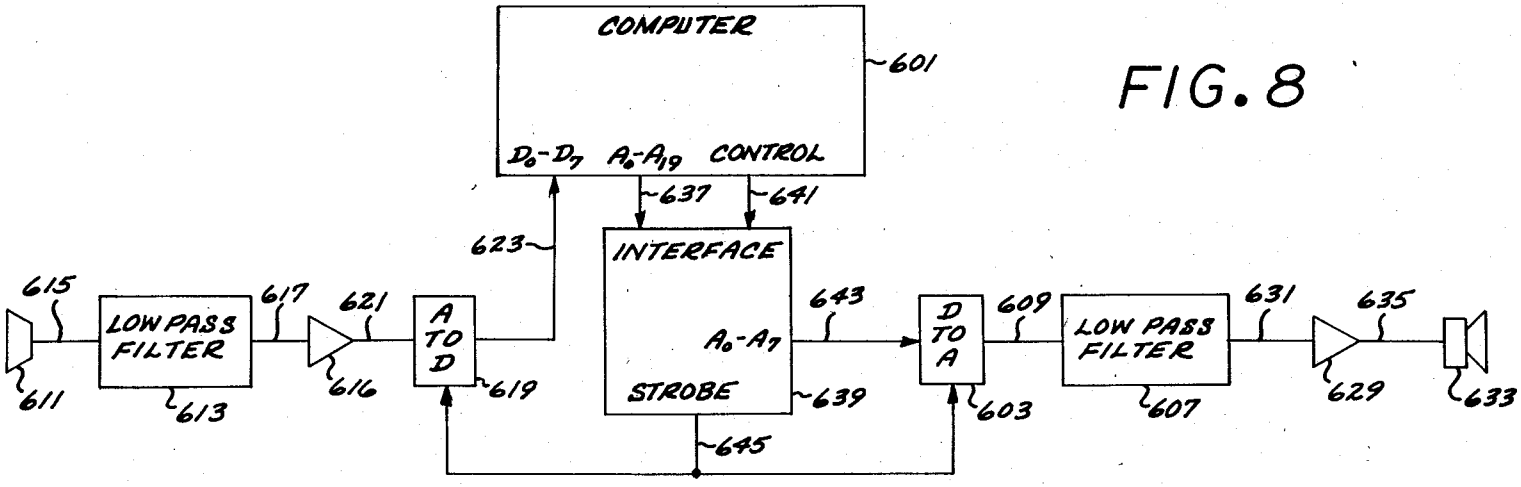
FIG. 8 illustrates a conventional connection of speech processing circuitry to a computer.

An alternate embodiment, showing the speech circuitry connected to the data, address and bus lines of the computer 601 is shown in FIG. 8. An interface block 639 receives address signals from the computer as indicated by a line 637, and control signals as indicated by a line 641, both of which connect the computer 601 to the interface block 639. The ADC 619 provides its output directly to the data bus of the computer 601 as indicated by the line 623. The interface block 639 decodes signals on the address bus and generates a strobe signal which is applied to the ADC 619 and to the DAC 603 as indicated by the line 645. Data carried by the lower address lines A0 through A7 are applied to the DAC 603 as indicated by a line 643 from the interface to the DAC 603.

Figure 9:
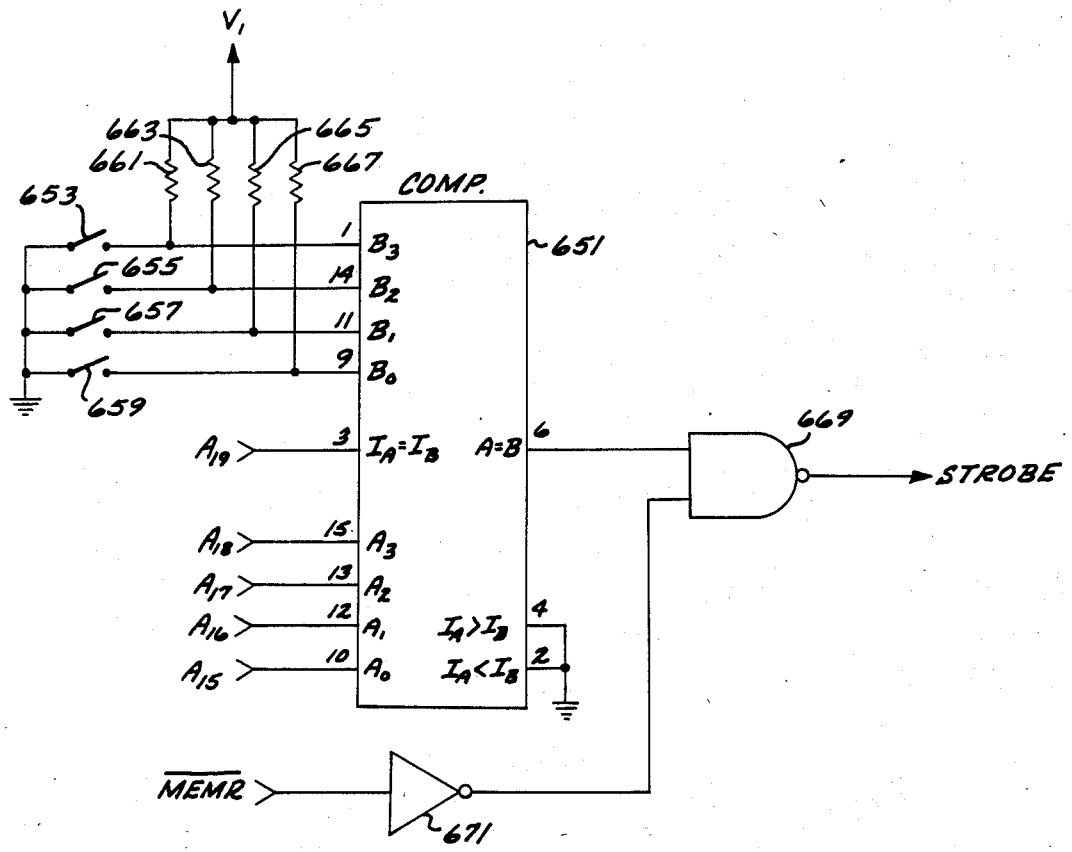
FIG. 9 illustrates an interface block as shown in FIG. 8.
Figure 10:
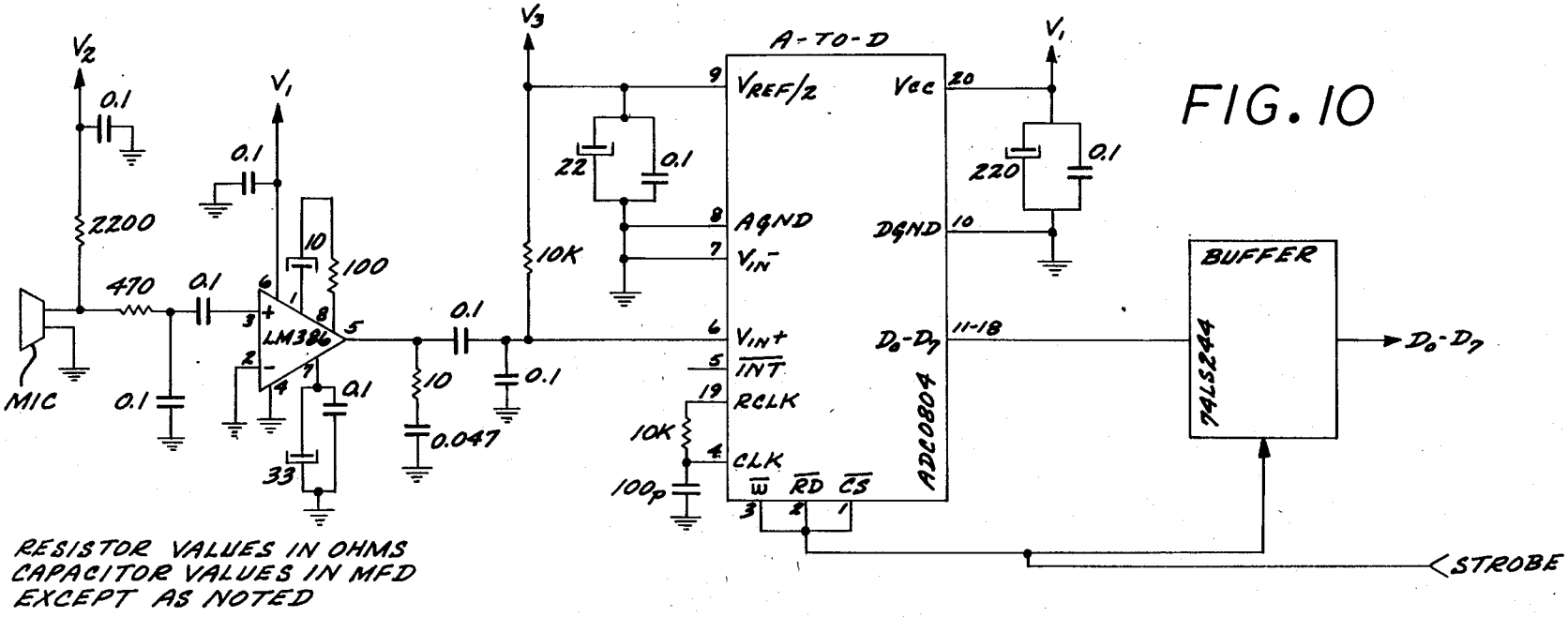
FIGS. 10 through 12 show a schematic diagram of the blocks (except block 601) illustrated in FIGS. 7 and 8.
Figure 11:
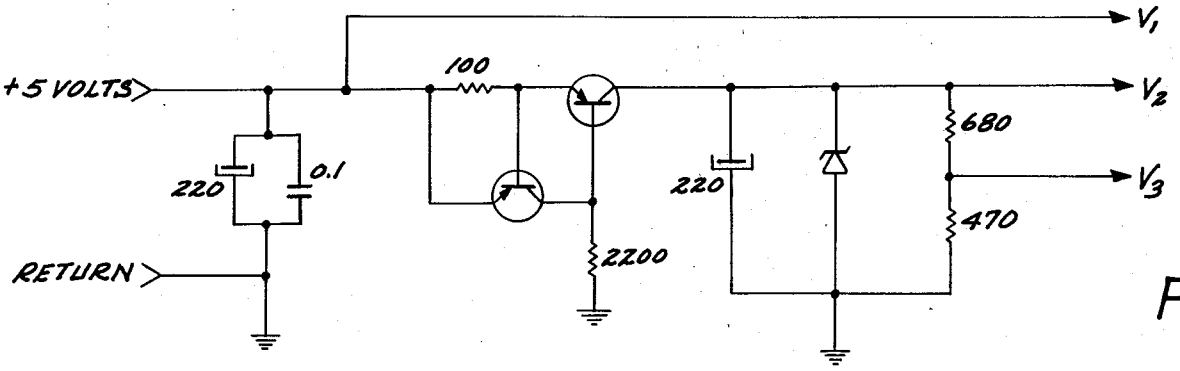
Figure 12:
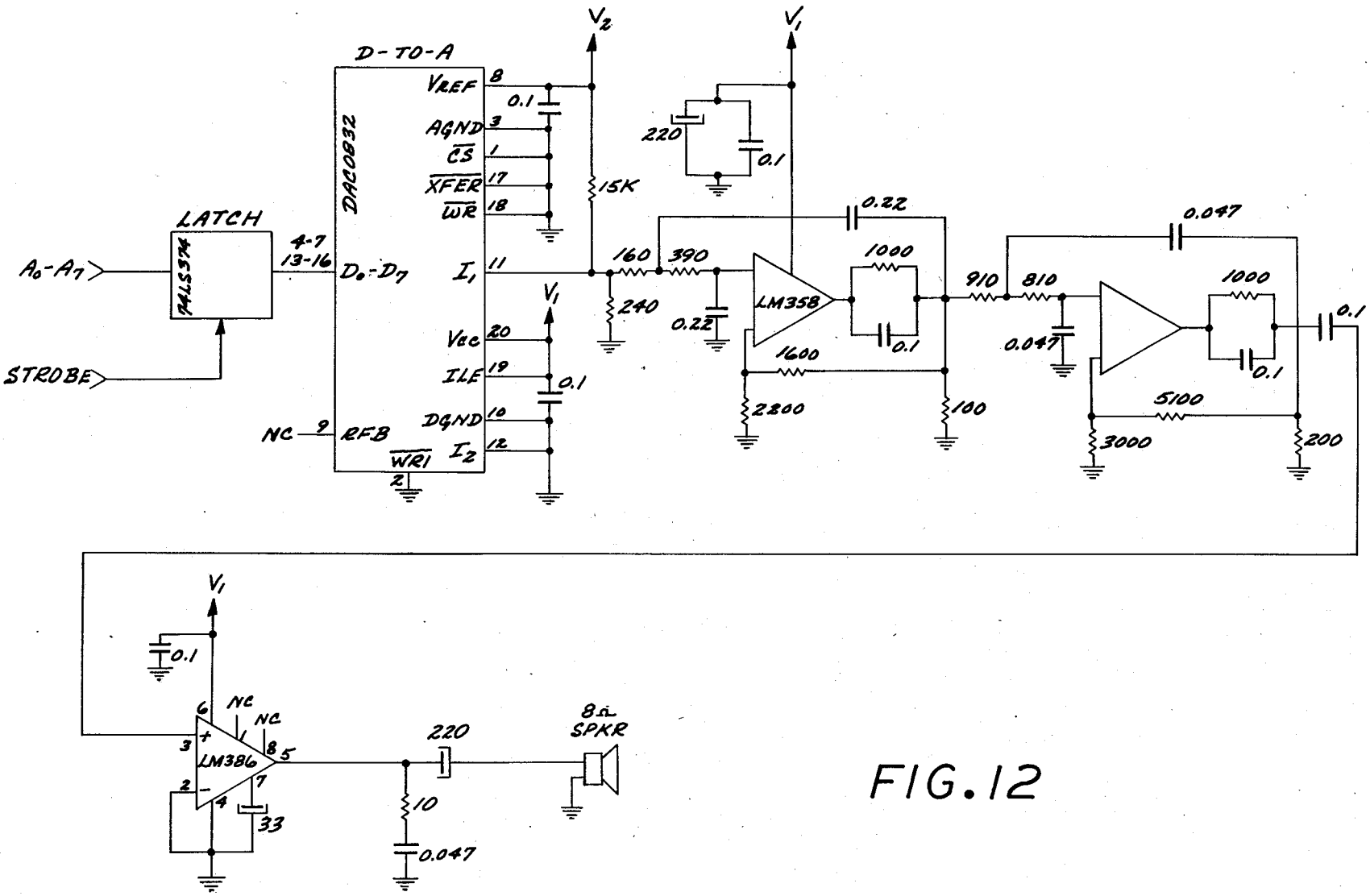

The interface block 639 is shown in more detail in FIG. 9. A comparator 651 receives a plurality of address bits from the address bus of the computer through its inputs a0 through a3 and Ia equal Ib. It also receives signals through its inputs b0 through b3 from a plurality of sense switches 653 through 659. Each sense switch has a pull up resistor 661 through 667, respectively, to tie the corresponding input of the comparator 651 to a positive reference when the corresponding sense switch is open.

An A equal B output of the comparator 651 is connected to a first input of a AND gate 669 and a "MEMR" control output from the computer is connected to the other input of the gate 669 through a gate 671. The output of the gate 669 provides a strobe signal. The A0 through A7 address lines from the computer connect directly to the data input of the digital to analog converter 603 and are not shown in FIG. 9. A latch, also not shown, may be used to buffer the input to the digital to analog converter 603 if required.

The sense switches 653 through 659 are set according to an absolute memory address to which it is desired the DAC to respond.

Figure 6A:
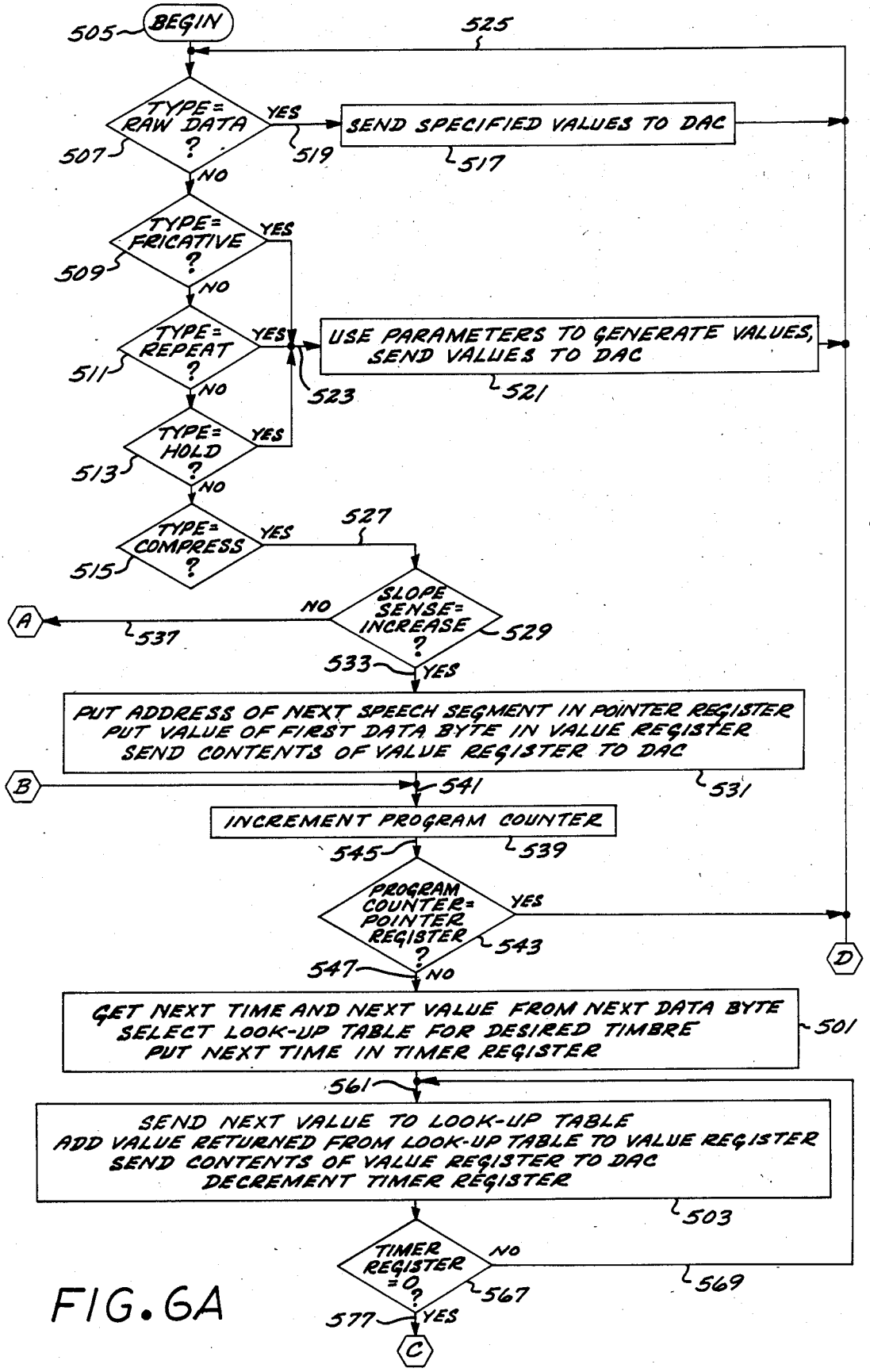
FIG. 6 is a flow chart illustrating a method of reproducing speech which has previously been compressed.
Figure 6B:
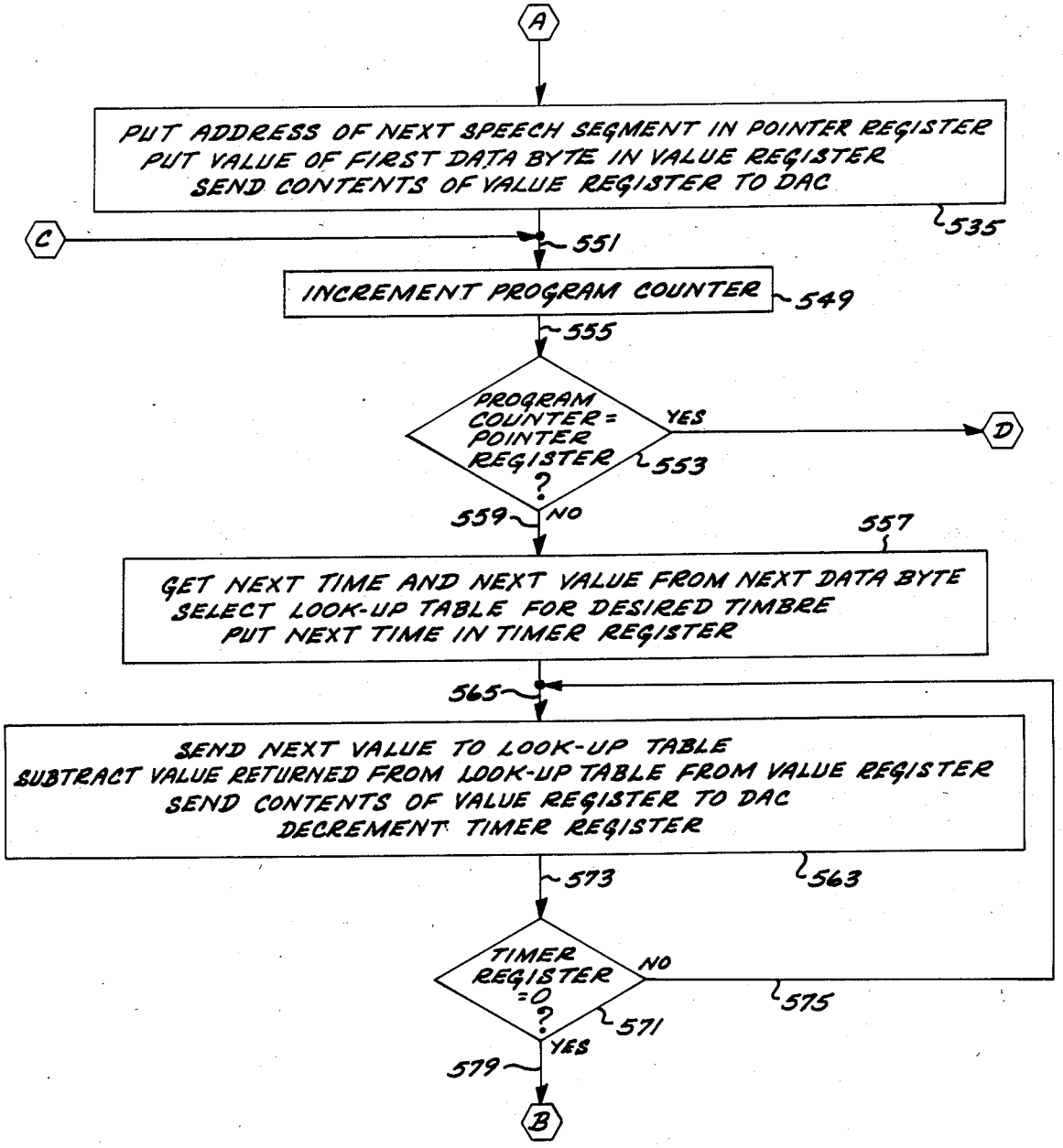

Attached hereto as an appendix, and incorporated herein by reference, is a source code printout indicating a preferred form of source code which can accomplish the instructions illustrated in the flow chart of FIGS. 6*a* and 6*b*. It will be apparent that the source code is written in Intel 8088 assembly language, as more particularly described and explained in any of a variety of standard reference texts, among them the text "IBM PC and XT Assembly Language" by Leo J. Scanlon, published Brady Books, 1985.

A computer speech system according to the present invention provides storage of data indicative of human speech in a compressed form, thereby enabling a relatively large quantity of data to be stored in a relatively small amount of storage space. The companded deltas and time values are particularly characteristic of the speech and can be used, in addition to reproducing the speech later, for various purposes, such as displaying on a monitor screen or the like a graphic representation of the speech in a form that enables a speaker to alter the speech to match a desired pattern. Also, the companded deltas and time values may be compared with other previously stored data or may be analyzed according to a predetermined procedure such as a mathematical rule or set of rules.

Although several specific embodiments of the invention have been described and illustrated, the invention is not to be limited to the specific forms or arrangements of parts so described and illustrated, and various modifications and changes can be made without departing from the scope and spirit of the invention. Within the scope of the appended claims, therefore, the invention may be practiced otherwise than as specifically described and illustrated.

APPENDIX

SOURCE CODE FOR GENERATING DAC OUTPUT FROM DATA STORED IN A SPEECH SEGMENT OF TYPE COMPRESS.

COPYRIGHT © 1987 BY KEITH JENKIN AND SHUFAN CHAN
ALL RIGHTS RESERVED

```
TYP12:    MOV OLDDI,DI   ES:DI points to the first byte of the present
                         speech segment. If the contents of the first
                         byte indicate that the present segment is of type
```

-continued

APPENDIX

SOURCE CODE FOR GENERATING DAC OUTPUT FROM DATA STORED IN A SPEECH SEGMENT OF TYPE COMPRESS.

COPYRIGHT © 1987 BY KEITH JENKIN AND SHUFAN CHAN
ALL RIGHTS RESERVED

| | | |
|---|---|---|
| | | COMPRESS and the initial slope sense is increase, execution jumps to the present TYP12 routine. The present instruction saves the contents of DI for possible later use if required by a subsequent speech segment of type REPEAT. |
| | INC DI | The second and third bytes of a speech segment of type COMPRESS contain the total number of data bytes contained in the segment. The present instruction points DI at these two bytes. |
| | MOV BP,ES:[DI] | Put the total number of data bytes contained in the present speech segment into BP. |
| | ADD DI,2 | Point DI to the first data byte. |
| | JMP GOUP0 | Go to the first instruction of the "Go Up" routine. |
| TYP14: | MOV OLDDI,DI | If the present speech segment is of type COMPRESS and the initial slope sense is decrease, execution jumps to TYP14. The present instruction and the following three instructions are similar to the corresponding instructions of TYP12. |
| | INC DI | |
| | MOV BP,ES:[DI] | |
| | ADD DI,2 | |
| | JMP GODN0 | Go to the first instruction of the "Go Down" routine. |
| GOUP0 | MOV DS,FVSEGT | The "Go Up"routine generates output from stored data corresponding with an increasing slope. "Go Up"comprises, in addition to GOUP0, GOUP, MOD1, GOUP1, MOD31, GOUP3, GOUP4, GOUP5, MOD3, GOUP6, GOUP7, and TOOHI. The present instruction points DS at the segment address (nicknamed "FVSEGT") to which the digital-to-analog converter ("DAC") will respond. |
| | ADD BP,DI | BP already contains the total number of data bytes in the present segment, and DI contains the address of the first data byte. The present instruction adds the number of bytes to the address of the first byte to get the address of the first byte of the following speech segment, thereby making BP point to the first byte of the following segment. |
| | MOV BL,ES:[DI] | Fetch the first data byte and put its value into the B register. |
| | MOV DH,[BX] | BH has previously been set to 0. Hence the contents of BX are simply the value of the first data byte which was put in BL in the previous instruction. The present instruction uses the contents of BX as an offset address and the contents of DS as a segment address to create a complete output address, then performs an operation at this output address. The DAC responds to the segment address contained in DS; therefore, performing any operation at the output address created by the present instruction causes the DAC to generate an analog output according to whatever data is present at its input. Since the input of the DAC is connected to the first 8 address lines, and since the contents of BL are on the first 8 address lines as a result of having been used to form the offset part of the address, the present instruction has the effect of causing the DAC to generate an output corresponding to the first data byte as contained in BL. Any instruction which would form the same address would do as well as the present instruction. Performing the present instruction, in addition to sending the value contained in BL to the DAC, also has the effect of transferring the output of the analog-to-digital converter ("ADC") into DH; this happens because both the DAC and the ADC respond to the same segment address. Thus, if it were desired to use the output of the ADC, it would be available in DH. The present routine has no need of the ADC output, hence the contents of DH are simply ignored. |
| GOUP: | INC DI | Point to the next data byte. Each data byte except the first contains a time interval in its |

-continued

APPENDIX

SOURCE CODE FOR GENERATING DAC OUTPUT FROM DATA STORED IN A SPEECH SEGMENT OF TYPE COMPRESS.

COPYRIGHT © 1987 BY KEITH JENKIN AND SHUFAN CHAN
ALL RIGHTS RESERVED

| | | |
|---|---|---|
| | | lower nibble and a companded difference in its upper nibble. |
| | CMP DI,BP | If DI = BP, the byte to which DI now points is the first byte of the following speech segment. |
| | JE COMDUN | If DI is pointing to the first byte of the following speech segment, exit this routine and go to the COMDUN routine to decide what to do next. COMDUN is used both by "Go Up"and by "Go Down" and in the present listing COMDUN follows "Go "Down". |
| | MOV CL,ES:8 DI] | Fetch the next data byte and put it into CL. |
| | MOV SI,CX | CH has previously been set to 0. Hence, this instruction puts the next data byte into SI. SI serves as an address pointer to various locations in the output look-up tables. |
| | SHL SI,1 | Double the contents of SI. This is done because each pointer in the lookup table to output add value strings comprises two bytes. |
| MOD1: | ADD SI,256 | There are several different look-up tables, each causing the output to have a different timbre. During program execution, a table has been selected by the operator. The present instruction shifts the contents of SI to point to the selected table, here designated by 256. |
| | ADD SI,CS:[SI] | Point to the first actual quantity to be added for output from the selected look-up table. |
| | AND CL,00001111B | CX will now be used as a counter to cause the correct number of outputs to be sent to the DAC. The present instruction removes the companded difference from the data byte in CL, leaving only the time interval. |
| | INC CX | During the compression process, the shortest time interval is encoded as a 0, the longest as a 15. To use CX as a counter, it is more convenient if the time intervals are coded as between 1 and 16. The present instruction re-codes the time intervals accordingly. |
| GOUP1: | DEC AX | Previously during program execution, AX has been loaded with a number indicating when a change of inflection should occur. The present instruction decrements AX to see if it is time to change inflection. by altering pitch by changing sample output rate |
| | JZ GOUP7 | If AX = 0, it is time to change inflection. Go to routine GOUP7 and do so. |
| | MOV DH,DL | DL contains a number which controls the length of a time delay to be inserted by the next routine. |
| MOD31: | ADD DH,0 | The present routine inserts a time delay at this point. Some computers execute faster than others; hence the length of the delay is a function of which kind of computer is being used. For a computer running an 8088 microprocessor at 4.7 MHz, 0 is the appropriate value. |
| | CALL LADDER | LADDER is a routine which generates a delay according to the contents of DH |
| GOUP3: | SUB BL,CS:[SI] | This instruction has the effect of "adding" the next number from the look-up table to BL to generate the next value to be sent to the DAC. |
| | JC TOOHI | If the carry flag was set during the previous instruction, the value in BL to be sent to the DAC is too "high". Go to routine TOOHI to fix this problem. |
| GOUP4: | MOV DH,[BX] | Send the contents of BL to the DAC |
| | LOOP GOUP5 | If CX is not zero, there are more outputs to be derived from the look-up table and sent to the DAC before moving on to the next data byte to GOUP5 to do this. |
| | JMP GODN | If CX is zero, all the outputs required by the present data byte have been sent to the DAC. The next data byte corresponds with a decreasing slope; hence, go to the GODN routine |
| GOUP5: | INC SI | Point to the next value in the look-up table to be sent to the DAC. |
| MOD3: | MOV DH,3 | The present routine prepares for a time delay to be inserted by the GOUP6 routine at this point |

-continued

APPENDIX

SOURCE CODE FOR GENERATING DAC OUTPUT FROM DATA STORED IN A SPEECH SEGMENT OF TYPE COMPRESS.

COPYRIGHT © 1987 BY KEITH JENKIN AND SHUFAN CHAN
ALL RIGHTS RESERVED

```
                        For a computer running an 8088 microprocessor at
                        4.7 MHz, 3 is the appropriate value
GOUP6:   DEC DH         This and the following instruction accomplish
                        the delay prepared by MOD3.
         JNZ GOUP6
         JMP GOUP1      Go execute routine GOUPl so as to send the next
                        value from the look-up table to the DAC.
GOUP7:   MOV AX,CS      This instruction and the following instruction
                        make DS point to the data area in preparation
                        for accomplishing the change of inflection.
         MOV DS,AX
         CALL INFADJ    INFADJ is a routine which accomplishes the in-
                        flection change.
         MOV            Make DS point to the address to which the DAC
         DS,FVSEGT
                        responds.
         JMP GOUP3      Continue program execution. The delay routine
                        MOD31 is skipped because execution of the present
                        routine has accomplished enough delay.
TOOHI:   MOV BL,0       If the number from the table, when "added"to BL,
                        gave a value which was too "high", 0 is loaded
                        into BL as the next value to be sent to the DAC.
         JMP GOUP4      Continue program execution.
GODN0    MOV            The "Go Down"routine generates output from
         DS,FVSEGT
                        stored data corresponding with a decreasing
                        slope. "Go Down"comprises, in addition to
                        GODN0, GODN, MOD2, GODN1, MOD41, GODN3, GODN4,
                        GODN5, MOD4, GODN6, GODN7, and TOOLO.
         ADD BP,DI
         MOV BL,ES:[DI]
         MOV DH,[BX]
GODN:    INC DI
         CMP DI,BP
         JE COMDUN
         MOV CL,ES:[DI]
         MOV SI,CX
         SHL SI,1
MOD2:    ADD SI,256
         ADD SI,CS:[SI]
         AND
         CL,00001111B
         INC CX
GODN1:   DEC AX
         JZ GODN7
         MOV DH,DL
MOD41:   ADD DH,0
         CALL LADDER
GODN3:   ADD BL,CS:[SI]  This instruction has the effect of "subtracting"
                         the next number from the look-up table from BL to
                         generate the next value to be sent to the DAC.
         JC TOOLO        If the carry flag was set during the previous
                         instruction, the value in BL to be sent to the
                         DAC is too "low". Go to routine TOOLO to fix
                         this problem.
GODN4:   MOV DH,[BX]
         LOOP GODN5
         JMP GOUP        If CX is zero, all the outputs required by the
                         present data byte have been sent to the DAC. The
                         next data byte corresponds with an increasing
                         slope; hence, go to the GOUP routine.
GODN5:   INC SI
MOD4:    MOV DH,3
GODN6:   DEC DH
         JNZ GODN6
         JMP GODN1
GODN7:   MOV AX,CS
         MOV DS,AX
         CALL INFADJ
         MOV
         DS,FVSEGT
         JMP GODN3
TOOLO:   MOV BL,255      If the number from the table, when "subtracted"
                         from BL, gave a value which was too "low", 255 is
                         loaded into BL as the next value to be sent to
                         the DAC.
         JMP GODN4
```

-continued

APPENDIX

SOURCE CODE FOR GENERATING DAC OUTPUT FROM DATA STORED IN A SPEECH SEGMENT OF TYPE COMPRESS.

COPYRIGHT © 1987 BY KEITH JENKIN AND SHUFAN CHAN
ALL RIGHTS RESERVED

```
COMDUN:   MOV SI,CS      This and the next instruction reset the data segment DS, which
                         was used to point to the DAC in
                         the above routines, back to a code segment.
          MOV DS,SI
          JMP NEXTTYP    NEXTTYP is a routine which decides what to do
                         next.
```

We claim:

1. A method of compressing a signal consisting of a stream of samples which represent a segment of human speech, the method comprising:

sequentially examining the samples until a sample is found which comprises a maximum in relation to its adjacent predecessor and successor samples;

sequentially examining the samples which follow the maximum sample until a sample is found which comprises a minimum in relation to its adjacent predecessor and successor samples;

calculating (1) a first delta number indicative of the algebraic difference between the minimum and maximum samples found in the preceding steps and (2) a first time number indicative of how much time elapsed between the occurrences of said minimum and maximum samples;

calculating (1) a first delta number indicative of the algebraic difference between the minimum and maximum samples found in the preceding steps and (2) a first time number indicative of how much time elapsed between the occurrences of said minimum and maximum samples;

sequentially examining the samples which follow said minimum sample until a sample is found which comprises a maximum in relation to its adjacent predecessor and successor samples; and calculating (1) a second delta number indicative of the algebraic difference between the maximum sample found in the preceding step and the minimum sample found previously and (2) a second time number indicative of how much time elapsed between the occurrences of the maximum sample found in the preceding step and the minimum sample found previously.

2. A method according to claim 1 wherein a delta number indicative of an algebraic difference comprises a companded representation of said difference.

3. A method according to claim 1 and further comprising packing a delta number and its corresponding time number for storage.

4. A method according to claim 1 and further comprising generating a visual display indicative of the delta numbers and the time numbers.

5. A method according to claim 1 and further comprising:

comparing the delta numbers and the time numbers with previously stored data; and providing an output indicative of the result of said comparison.

6. A method of compressing a signal consisting of a stream of samples which represent a segment of human speech, the method comprising:

sequentially examining the samples until a sample is found which comprises a maximum in relation to its adjacent predecessor and successor samples;

sequentially examining the samples which follow the maximum sample until a sample is found which comprises a minimum in relation to its adjacent predecessor and successor samples;

calculating (1) a first delta number indicative of the algebraic difference between the minimum sample found in the preceding step and a max reference determined according to the maximum sample and (2) a first time number indicative of how much time elapsed between the occurrences of said minimum and maximum samples;

companding the first delta number to provide a first companded delta number;

sequentially examining the samples which follow said minimum sample until a sample is found which comprises a maximum in relation to its adjacent predecessor and successor samples;

calculating (1) a second delta number indicative of the algebraic difference between the maximum sample found in the preceding step and a min reference value determined according to the minimum sample found previously and (2) a second time number indicative of how much time elapsed between the occurrences of the maximum sample found in the preceding step and the minimum sample found previously; and companding the second delta number to provide a second companded delta number.

7. A method according to claim 6 and further comprising comparing a companded delta number with a test value; and if the companded delta number exceeds the test value, setting the companded delta number equal to the test value.

8. A method according to claim 6 and further comprising packing a companded delta number and its corresponding time number for storage.

9. A method according to claim 6 and further comprising generating a visual display indicative of the companded delta numbers and the time numbers.

10. A method according to claim 6 and further comprising:

comparing the companded delta numbers and the time numbers with previously stored data; and providing an output indicative of the result of said comparison.

11. A method of compressing a signal consisting of a stream of samples which represent a segment of human speech, the method comprising:

sequentially examining the samples until a sample is found which comprises a maximum in relation to its adjacent predecessor and successor samples;

sequentially examining the samples which follow the maximum sample until a sample is found which comprises a minimum in relation to its adjacent predecessor and successor samples;

calculating (1) a first delta number indicative of the algebraic difference between the minimum sample found in the preceding step and a max reference determined according to the maximum sample and (2) a first time number indicative of how much time elapsed between the occurrences of said minimum and maximum samples;

if the first time number does not exceed a predetermined time, companding the first delta number to provide a first companded delta number;

if the first time number exceeds the predetermined time, scaling the first delta number and the first time number according to a time adjustment factor and then companding the scaled first delta number to provide a first companded delta number;

sequentially examining the samples which follow said minimum sample until a sample is found which comprises a maximum in relation to its adjacent predecessor and successor samples;

calculating (1) a second delta number indicative of the algebraic difference between the maximum sample found in the preceding step and a min reference value determined according to the minimum sample found previously and (2) a second time number indicative of how much time elapsed between the occurrences of the maximum sample found in the preceding step and the minimum sample found previously;

if the second time number does not exceed said predetermined time, companding the second delta number to provide a second companded delta number; and if the second time number exceeds the predetermined time, scaling the second delta number and the second time number according to said time adjustment factor and then companding the scaled second delta number to provide a second companded delta number.

12. A method according to claim 11 and further comprising:

comparing a companded delta number with a test value; and if the companded delta number exceeds the test value, setting the companded delta number equal to the test value.

13. A method according to claim 11 and further comprising packing a companded delta number and its corresponding time number for storage.

14. A method according to claim 11 and further comprising generating a visual display indicative of the companded delta numbers and the time numbers.

15. A method according to claim 11 and further comprising:

comparing the companded delta numbers and the time numbers with previously stored data; and providing an output indicative of the result of said comparison.

16. A method of compressing a signal consisting of a stream of samples which represent a segment of human speech, the method comprising:

sequentially examining the samples until a sample is found which comprises a maximum in relation to its adjacent predecessor and successor samples;

calculating (1) a reference delta number indicative of the algebraic difference between said maximum sample and a previously determined min reference value and (2) a reference time number indicative of how much time elapsed between said maximum sample and a predetermined reference time;

companding the reference delta number to provide a companded reference delta number;

determining a max reference value by adding the companded reference delta number to said min reference value;

sequentially examining the samples which follow said maximum sample until a sample is found which comprises a minimum in relation to its adjacent predecessor and successor samples;

calculating (1) a first delta number indicative of the algebraic difference between the minimum sample found in the preceding step and said max reference value and (2) a first time number indicative of how much time elapsed between the occurrences of the minimum sample found in the preceding step and the maximum sample found previously;

companding the first delta number to provide a first companded delta number;

determining a new min reference value by subtracting the first companded delta number from the max reference value;

replacing the previously determined min reference value with the new min reference value determined in the preceding step;

sequentially examining the samples which follow said minimum sample until a sample is found which comprises a maximum in relation to its adjacent predecessor and successor samples;

calculating (1) a second delta number indicative of the algebraic difference between the maximum sample found in the preceding step and the min reference value and (2) a second time number indicative of how much time elapsed between the occurrences of the maximum sample found in the preceding step and the minimum sample found previously;

companding the second delta number to provide a second companded delta number;

determining a new max reference value by adding the second companded delta number to the min reference value; and replacing the previously determined max reference value with the new max reference value determined in the preceding step.

17. A method according to claim 16 and further comprising, before the step of determining a new reference value:

comparing a companded delta number with a test value; and if the companded delta number exceeds the test value, setting the companded delta number equal to the test value.

18. A method according to claim 16 and further comprising packing a companded delta number and its corresponding time number for storage.

19. A method according to claim 16 and further comprising generating a visual display indicative of the companded delta numbers and the time numbers.

20. A method according to claim 16 and further comprising:

comparing the companded delta numbers and the time numbers with previously stored data; and providing an output indicative of the result of said comparison.

21. A method of compressing a signal consisting of a stream of samples which represent a segment of human speech, the method comprising:

sequentially examining the samples until a sample is found which comprises a maximum in relation to its adjacent predecessor and successor samples;

calculating (1) a reference delta number indicative of the algebraic difference between said maximum sample and a previously determined min reference value and (2) a reference time number indicative of how much time elapsed between said maximum sample and a predetermined reference time;

if the reference time number does not exceed a predetermined time, companding the reference delta number to provide a companded reference delta number;

if the reference time number exceeds the predetermined time, scaling the reference delta number and the reference time number according to a time adjustment factor and then companding the scaled reference delta number to provide a companded reference delta number;

determining a max reference value by adding the companded reference delta number to said min reference value;

sequentially examining the samples which follow said maximum sample until a sample is found which comprises a minimum in relation to its adjacent predecessor and successor samples;

calculating (1) a first delta number indicative of the algebraic difference between the minimum sample found in the preceding step and said max reference value and (2) a first time number indicative of how much time elapsed between the occurrences of the minimum sample found in the preceding step and the maximum sample found previously;

if the first time number does not exceed said predetermined time, companding the first delta number to provide a first companded delta number;

if the first time number exceeds the predetermined time, scaling the first delta number and the first time number according to said time adjustment factor and then companding the scaled first delta number to provide a first companded delta number;

determining a new min reference value by subtracting the first companded delta number from the max reference value;

replacing the previously determined min reference value with the new min reference value determined in the preceding step;

sequentially examining the samples which follow said minimum sample until a sample is found which comprises a maximum in relation to its adjacent predecessor and successor samples;

calculating (1) a second delta number indicative of the algebraic difference between the maximum sample found in the preceding step and the min reference value and (2) a second time number indicative of how much time elapsed between the occurrences of the maximum sample found in the preceding step and the minimum sample found previously;

if the second time number does not exceed said predetermined time, companding the second delta number to provide a second companded delta number;

if the second time number exceeds the predetermined time, scaling the second delta number and the second time number according to said time adjustment factor and then companding the scaled second delta number to provide a second companded delta number;

determining a new max reference value by adding the second companded delta number to the min reference value; and replacing the previously determined max reference value with the new max reference value determined in the preceding step.

22. A method according to claim 21 and further comprising, before the step of determining a new reference value:

comparing a companded delta number with a test value; and if the companded delta number exceeds the test value, setting the companded delta number equal to the test value.

23. A method according to claim 21 and further comprising packing a companded delta number and its corresponding time number for storage.

24. A method according to claim 21 and further comprising generating a visual display indicative of the companded delta numbers and the time numbers.

25. A method according to claim 21 and further comprising:

comparing the companded delta numbers and the time numbers with previously stored data; and providing an output indicative of the result of said comparison.

26. A method of generating a speech signal from data indicative of a segment of human speech, the method comprising:

computing a numerical value indicative of the data;

deriving a computer address according to the computed numerical value;

causing a computer to perform an operation accessing the derived address; and applying the derived address to a data input of a signal generating device.

27. A method according to claim 26 wherein the step of deriving a computer address comprises combining the numerical value with a predetermined segment address value to derive the address, an offset portion of the derived address being indicative of said numerical value.

28. A method according to claim 27 wherein the step of applying the derived address to the data input comprises applying the offset portion of the derived address to the data input.

29. A method according to claim 28 wherein the step of combining the numerical and segment address values comprises:

storing the numerical value in a first computer register;

storing a predetermined segment address value in a second computer register; and combining the contents of the first register with the contents of the second register to derive the computer address.

30. A method according to claim 29 wherein the step of combining the contents of the registers comprises:

multiplying the contents of the second register by a constant to provide a segment address; and adding the segment address to the contents of the first register.

31. A method according to claim 26 wherein the step of computing the numerical value comprises looking up a numerical value in a look-up table.

32. Apparatus for generating a speech signal, the apparatus comprising:

a computer including data storage means and an address bus;

means for storing data indicative of a segment of human speech in the data storage means;

means for computing a numerical value indicative of the stored data;

means for deriving a computer address according to the computed numerical value;

means for causing the computer to put the derived address on the address bus; and means for applying the derived address to a data input of a signal generating device.

33. Apparatus according to claim 32 wherein the signal generating device comprises a digital-to-analog converter having a data input in electrical communication with the address bus and responsive to an address placed on the address bus to provide an analog signal indicative of the numerical value of said address.

34. Apparatus according to claim 33 and further comprising a low-pass filter operative to filter the analog signal to provide a speech signal.

35. Apparatus according to claim 32 wherein means for deriving a computer address comprises means for combining the numerical value with a predetermined segment address value to derive the address, an offset portion of the derived address being indicative of said numerical value.

36. Apparatus according to claim 35 wherein the means for combining the numerical and segment address values comprises:

a first computer register, operative to store the numerical value;

a second computer register, operative to store a predetermined segment address value; and means for combining the contents of the first register with the contents of the second register to derive the computer address.

37. A method of storing and reproducing a plurality of segments of human speech, each segment represented by a stream of samples, the method comprising:

selecting a speech segment to be stored;

selecting one of a plurality of segment processing types, one of which types comprises compressing;

storing a value indicative of which segment processing type was selected;

deriving data indicative of the speech segment to be stored according to which segment type was selected;

storing the derived data;

computing a numerical value indicative of the stored data;

deriving a computer address according to the computed numerical value;

causing a computer to perform an operation accessing the derived address; and applying the derived address to a data input of a signal generating device.

38. A method according to claim 37 wherein the compressing type comprises:

sequentially examining samples indicative of the speech segment until a sample is found which comprises a maximum in relation to its adjacent predecessor and successor samples;

sequentially examining the samples which follow the maximum sample until a sample is found which comprises a minimum in relation to its adjacent predecessor and successor samples;

calculating (1) a first delta number indicative of the algebraic difference between the minimum and maximum samples found in the preceding steps and (2) a first time number indicative of how much times elapsed between the occurrences of the minimum and maximum samples found in the preceding steps;

packing the first delta number and the first time number for storage;

sequentially examining the samples which follow said minimum sample until a sample is found which comprises a maximum in relation to its adjacent predecessor and successor samples;

calculating (1) a second delta number indicative of the algebraic difference between the maximum sample found in the preceding step and the minimum sample found previously and (2) a second time number indicative of how much time elapsed between the occurrences of the maximum sample found in the preceding step and the minimum sample found previously; and packing the second delta number and the second time number for storage.

39. A method according to claim 38 wherein a delta number indicative of an algebraic difference comprises a companded representation of said difference.

40. A method according to claim 1 and further comprising analyzing the delta numbers and time numbers in accordance with a predetermined procedure.

41. A method according to claim 40 wherein the predetermined procedure comprises a mathematical rule.

* * * * *